US005735519A

United States Patent [19]

Ozawa et al.

[11] Patent Number: 5,735,519

[45] Date of Patent: Apr. 7, 1998

[54] PHOTOSENSITIVE-MATERIAL CONVEYING APPARATUS

[75] Inventors: Yoshio Ozawa; Takasi Ogiso, both of Kanagawa, Japan

[73] Assignee: Fuji Photo Film Co., Ltd., Kanagawa, Japan

[21] Appl. No.: 580,395

[22] Filed: Dec. 28, 1995

[30] Foreign Application Priority Data

| | | | |
|---|---|---|---|
| Feb. 9, 1995 | [JP] | Japan | 7-021635 |
| Feb. 28, 1995 | [JP] | Japan | 7-040439 |
| Feb. 28, 1995 | [JP] | Japan | 7-040440 |

[51] Int. Cl.[6] ..... B65H 39/10

[52] U.S. Cl. ..... 271/294

[58] Field of Search ..... 271/292, 294, 271/295, 221; 270/58.19

[56] References Cited

U.S. PATENT DOCUMENTS

| | | | |
|---|---|---|---|
| 2,561,070 | 7/1951 | Phythian . | |
| 4,824,307 | 4/1989 | Johnson et al. . | |
| 5,052,679 | 10/1991 | Sekino | 271/294 X |

FOREIGN PATENT DOCUMENTS

| | | | |
|---|---|---|---|
| 2529692 | 7/1982 | France | G03D 3/08 |
| 62-168059 | 10/1987 | Japan | B65H 31/28 |
| 63-272749 | 11/1988 | Japan | B65H 39/105 |
| 5289292 | 11/1993 | Japan | G03D 15/00 |

*Primary Examiner*—David H. Bollinger

*Attorney, Agent, or Firm*—Sughrue, Mion, Zinn, Macpeak & Seas, PLLC

[57] ABSTRACT

A photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, the photosensitive-material conveying apparatus being adapted to stack the cut photosensitive material in a predetermined unit. The apparatus is comprised of: an endlessly conveying section disposed above the main body and on a photosensitive-material discharging side of the cutter section, an upper portion of the endlessly conveying section being disposed in a vicinity of the discharging section, a lower portion of the endlessly conveying section being disposed at a position remote from the discharging section, such that a conveying direction is inclined with respect to a vertical direction; a placing member disposed below the discharging section so as to place thereon the cut photosensitive material discharged from the discharging section; a photosensitive-material receiving member provided in the endlessly conveying section to place the cut photosensitive material thereon; and a pushing-out member adapted to come into contact with one end of the cut photosensitive material placed on the placing member to push out the cut photosensitive material to a predetermined position on the photosensitive-material receiving member.

20 Claims, 31 Drawing Sheets

PHOTOSENSITIVE-MATERIAL CONVEYING APPARATUS

BACKGROUND OF THE INVENTION

1. Field of the Invention

The present invention relates to a photosensitive-material conveying apparatus for sorting sheets of a photosensitive material, such as cut prints, for respective orders.

2. Description of the Related Art

A printer processor is provided with a conveying apparatus for sorting cut prints for respective orders.

As shown in FIG. 29, a printer processor 600 is provided with a printer section 14 for printing and a processor section 16 for effecting development, fixing, washing, drying, and the like. Printing paper is cut to a predetermined size by a cutter section 18 disposed above a drying section 16A of the processor section 16, and is discharged in a lateral direction by a pair of discharge rollers 30 located in an upper portion of the cutter section 18.

A conventional sorting/conveying apparatus 602 is disposed above the processor section 16 and beside the cutter section 18, and has a conveyor 604 arranged vertically and adapted to move in a circulating manner. This conveyor 604 is provided with receiving trays 606 at predetermined intervals for receiving prints, and an upright wall portion 606A is formed at the cutter section 18 side of each receiving tray 606.

A one-order portion (e.g., a one-film portion) of prints is stacked in each tray 606, and after the one-order portion of prints is stacked, the receiving trays 606 are consecutively moved downward.

As shown in FIG. 30, the receiving trays 606 are slightly spaced apart from the cutter section 18 so as not to come into contact with the cutter section 18. Each cut print 20A is nipped and discharged by the pair of discharge rollers 30, but the dropped position varies depending on various conditions. For this reason, with the conventional sorting/conveying apparatus 602, the trailing ends of the cut prints 20A are liable to be caught by the upright wall portion 606A of the receiving tray 606, making the accumulation unstable. If the accumulation of the cut prints 20A is unstable, it is necessary to properly arrange the accumulated cut prints 20A by a manual operation, which takes time and trouble.

In addition, since a height H (see FIG. 29) from the upper surface of the processor section 16 to a nip between the discharge rollers 30 is predetermined from the viewpoint of the installation space, ease in handling, and the like, there is a limit to the number of the receiving trays 606 which are attached to the conveyor 604. Hence, it has been impossible to cope with an increase in the number of stacks of prints (the number of orders).

In addition, as shown in FIGS. 31 and 32, there has been proposed a printer processor 610 having a sorting/conveying apparatus 616 which accumulates the cut prints 20A between partition plates 614 of a conveyor 612 adapted to move horizontally as the cut prints 20A are allowed to drop freely from the cutter section 18. However, since this system relies on the free drop, the accumulation is unstable, so that there is a problem in that the state of alignment during accumulation is liable to vary depending on the length of the cut prints 20A and a curled state.

SUMMARY OF THE INVENTION

In view of the above-described circumstances, it is an object of the present invention to provide a photosensitive-material conveying apparatus which is capable of enhancing the stability of accumulation of prints, and coping with an increase in the number of stacks.

In accordance with a first aspect of the present invention, there is provided a photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, the photosensitive-material conveying apparatus being adapted to stack the cut photosensitive material in a predetermined unit, the photosensitive-material conveying apparatus comprising: an endlessly conveying section disposed above the main body and on a photosensitive-material discharging side of the cutter section, an upper portion of the endlessly conveying section being disposed in a vicinity of the discharging section, a lower portion of the endlessly conveying section being disposed at a position remote from the discharging section, such that a conveying direction is inclined with respect to a vertical direction; a placing member disposed below the discharging section so as to place thereon the cut photosensitive material discharged from the discharging section; a photosensitive-material receiving member provided in the endlessly conveying section to place the cut photosensitive material thereon; and a pushing-out member adapted to come into contact with one end of the cut photosensitive material placed on the placing member to push out the cut photosensitive material to a predetermined position on the photosensitive-material receiving member.

In accordance with a second aspect of the present invention, there is provided a photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, the photosensitive-material conveying apparatus being adapted to stack the cut photosensitive material in a predetermined unit, the photosensitive-material conveying apparatus comprising: an endlessly conveying section disposed above the main body and on a photosensitive-material discharging side of the cutter section, an upper portion of the endlessly conveying section being disposed in a vicinity of the discharging section, a lower portion of the endlessly conveying section being disposed at a position remote from the discharging section, such that a conveying direction is inclined with respect to a vertical direction; a placing member disposed below the discharging section so as to place thereon the cut photosensitive material discharged from the discharging section; a photosensitive-material receiving member provided in the endlessly conveying section to place thereon the cut photosensitive material discharged from the discharging section; and a driving member capable of moving the photosensitive-material receiving member until a discharging section-side end of the photosensitive-material receiving member is located on an upstream side, as viewed in a direction of flow of the photosensitive material being discharged, of a vertical line passing through a discharging end of the discharging section when the photosensitive-material receiving member is located in a vicinity of the discharging section.

In accordance with a third aspect of the present invention, there is provided a photosensitive-material conveying apparatus for conveying a photosensitive material, the photosensitive-material conveying apparatus comprising: an endlessly conveying section; a stacking member provided in the endlessly conveying section to stack the photosensitive material thereon; a guide member provided along a conveying passage of the endlessly conveying section; and an inclination preventing member provided in the stacking member to maintain the stacking member in a predetermined orientation as the inclination preventing member is guided by the guide member.

In accordance with a fourth aspect of the present invention, there is provided a photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, the photosensitive-material conveying apparatus being disposed on a photosensitive-material discharging side of the discharging section, the photosensitive-material conveying apparatus comprising: a placing member disposed below the discharging section to place thereon the photosensitive material discharged from the discharging section; a conveying member having a photosensitive-material receiving member which is disposed laterally of the placing member to place the photosensitive material thereon, the conveying member being adapted to convey the photosensitive material from a lateral direction of the placing member to a predetermined position; a pushing-out member for pushing out the photosensitive material onto the photosensitive-material receiving member located laterally of the placing member as the pushing-out member abuts against a discharging section-side end of the photosensitive material placed on the placing member; and a stopper disposed on a side of the photosensitive-material receiving member which is away from a side thereof where the placing member is disposed, the stopper being adapted to hold an end of the photosensitive material so that the photosensitive material placed on the photosensitive-material receiving member is not offset toward a side of a predetermined position which is away from a discharge section side thereof.

In accordance with a fifth aspect of the present invention, in the photosensitive-material conveying apparatus according to the fourth aspect of the invention, the stopper retreats when the pushing-out member pushes out the photosensitive material.

In the first aspect of the present invention, the photosensitive material subjected to printing, development, and dry processing in the printer processor is cut to a predetermined length by the cutter section, and is discharged from the discharging section, and a predetermined number of sheets (e.g., a one-order portion) of the photosensitive material are temporarily placed on the placing member. When the predetermined number of sheets of the photosensitive material are placed on the placing member, the trailing ends of the sheets of the cut photosensitive material are pushed by the pushing-out member, so that the cut sheets of the photosensitive material are pushed out to a predetermined position on the photosensitive-material receiving member. When the cut sheets of the photosensitive material are placed on the photosensitive-material receiving member, the endlessly conveying section rotates, and the photosensitive-material receiving member with the cut sheets of the photosensitive material placed thereon is moved downward.

Since the cut sheets of the photosensitive material are pushed out to a predetermined position on the photosensitive-material receiving member, the cut sheets of the photosensitive material can be conveyed with one ends thereof arranged.

Further, since the conveying direction of the endlessly conveying section is inclined with respect to the vertical direction, in a case where conveyance is effected over the same heightwise dimension, the conveying distance can be made longer than that of the conventional apparatus in which the conveying direction is vertical. Hence, it is possible to provide a larger number of photosensitive-material receiving members and to prepare for a larger number of orders.

In the second aspect of the present invention, the photosensitive-material receiving member disposed in face-to-face relation to the discharging section is slid by the driving member, and the discharging section-side end of the photosensitive-material receiving member is located on the upstream side, as viewed in the direction of flow of the photosensitive material being discharged, of a vertical line passing through the discharging end of the discharging section. Then, the photosensitive material subjected to printing, development, and dry processing by the printer processor is cut to a predetermined length by the cutter section, and is discharged from the discharging section, and a predetermined number of sheets (e.g., a one-order portion) of the photosensitive material are stacked on the photosensitive-material receiving member. When the predetermined number of sheets of the photosensitive material are stacked on the photosensitive-material receiving member, the endlessly conveying section rotates, and the photosensitive-material receiving member with the cut sheets of the photosensitive material placed thereon is moved downward.

When the cut sheets of the photosensitive material are stacked, since the discharging section-side end of the photosensitive-material receiving member is located on the upstream side, as viewed in the direction of flow of the photosensitive material being discharged, of a vertical line passing through the discharging end of the discharging section, even if the dropped position of the cut sheets of the photosensitive material slightly varies, the cut sheets of the photosensitive material are not caught by the end of the photosensitive-material receiving member, and are accumulated in parallel inside the photosensitive-material receiving member.

Further, since the conveying direction of the endlessly conveying section is inclined with respect to the vertical direction, in a case where conveyance is effected over the same heightwise dimension, the conveying distance can be made longer than that of the conventional apparatus in which the conveying direction is vertical. Hence, it is possible to provide a larger number of photosensitive-material receiving members and to prepare for a larger number of orders.

In accordance with the third aspect of the present invention, the apparatus can be used for a printer processor, for example. The photosensitive material subjected to printing, development, and dry processing by the printer processor is cut to a predetermined length by the cutter section, and is discharged from the discharging section, and a predetermined number of sheets (e.g., a one-order portion) of the photosensitive material are placed on the stacking member. Subsequently, the stacking member with the sheets of the photosensitive material stacked thereon is moved to a predetermined position by the endlessly conveying section.

In this aspect of the present invention, the inclination of the stacking member can be prevented by allowing the guide member to guide the inclination preventing member for preventing the inclination of the stacking member. For this reason, the stacking member can be moved while maintaining a predetermined attitude, so that the photosensitive material is conveyed in a stable state. In particular, in a case where the sheets of the photosensitive material are stacked, the stacked sheets of the photosensitive material are prevented from becoming offset.

Incidentally, as for the guide member, it suffices if the guide member is provided at least in a range in which the inclination of the stacking member is to be prevented, and the guide member need not necessarily be provided over the entire length of the endlessly conveying section.

As the endlessly conveying section, it is possible to cite, for example, a metal chain, a rubber belt, and the like, but it is possible to use another similar member.

As the guide member, it is possible to cite, for example, a straight rod-like member or the like, but it is possible to use another similar member, e.g., a predetermined member provided with a groove or the like.

In addition, as the inclination preventing member, it is possible to cite, for example, a pair of rollers provided in such a manner as to be located on both sides of the guide member, a sliding member having a low coefficient of friction and adapted to slide on the guide, or another similar member. Incidentally, if the guide member is one having a groove or the like, the inclination preventing member is movably fitted in that groove.

In accordance with the fourth aspect of the present invention, the apparatus can be used for a printer processor, for example. The photosensitive material (a sheet-like material) subjected to printing, development, and dry processing by the printer processor is cut to a predetermined length by the cutter section, and is discharged from the discharging section.

The discharged photosensitive material is dropped laterally of the discharging section, and is temporarily placed on the placing member. When the photosensitive material is placed on the placing member, the photosensitive-material receiving member is set in advance on the side of the placing member, allowing part of the photosensitive material to be supported by the photosensitive-material receiving member.

Here, when an elongated sheet of the photosensitive material is placed, and another elongated sheet of the photosensitive material is discharged and placed thereon from a lateral direction, the uppermost sheet of the photosensitive material tends to be pushed in the discharging direction by the leading end of the photosensitive material being discharged. At this time, the stopper holds the end of the photosensitive material so that the photosensitive material is not offset from a predetermined position in the discharging direction.

After a predetermine number of sheets (e.g., a one-order portion) of the photosensitive material are stacked, the stacked sheets of the photosensitive material are pushed out a predetermined dimension by the pushing-out member, such that all the stacked sheets are moved to the interior of the photosensitive-material receiving member.

Here, the position at which the stopper holds the end of the photosensitive material is offset from the photosensitive-material-discharging-direction side end of the photosensitive-material receiving member toward the discharging section by more than a pushing-out dimension for pushing out the photosensitive material by the pushing-out member. Consequently, when the photosensitive material is discharged by the pushing-out member, the photosensitive material is prevented from projecting from the photosensitive-material-discharging-direction side end of the photosensitive-material receiving member. Even if a wall or the like is located adjacent the photosensitive-material-discharging-direction side of the photosensitive-material receiving member, the photosensitive material can be prevented from coming into contact with the wall or the like.

Subsequently, the endlessly conveying section is actuated, so that the photosensitive-material receiving member with the photosensitive material stacked thereon can be moved to a predetermined position.

In accordance with the fifth aspect of the present invention, the stopper retreats when the pushing-out member pushes out the photosensitive material. Incidentally, the pushing-out operation by the pushing-out member and the retreat of the stopper may or may not be effected simultaneously. As the stopper is made to retreat, the photosensitive material can be pushed to the deep interior of the photosensitive-material receiving member by the pushing-out member. As a result, effective use can be made of the interior of the photosensitive-material receiving member.

The above and other objects, features and advantages of the present invention will become more apparent from the following detailed description of the invention when read in conjunction with the accompanying drawings.

DESCRIPTION OF THE PREFERRED EMBODIMENTS

First Embodiment

Referring now to FIGS. 1 to 8, a description will be given of a first embodiment of the present invention.

Figure 2:
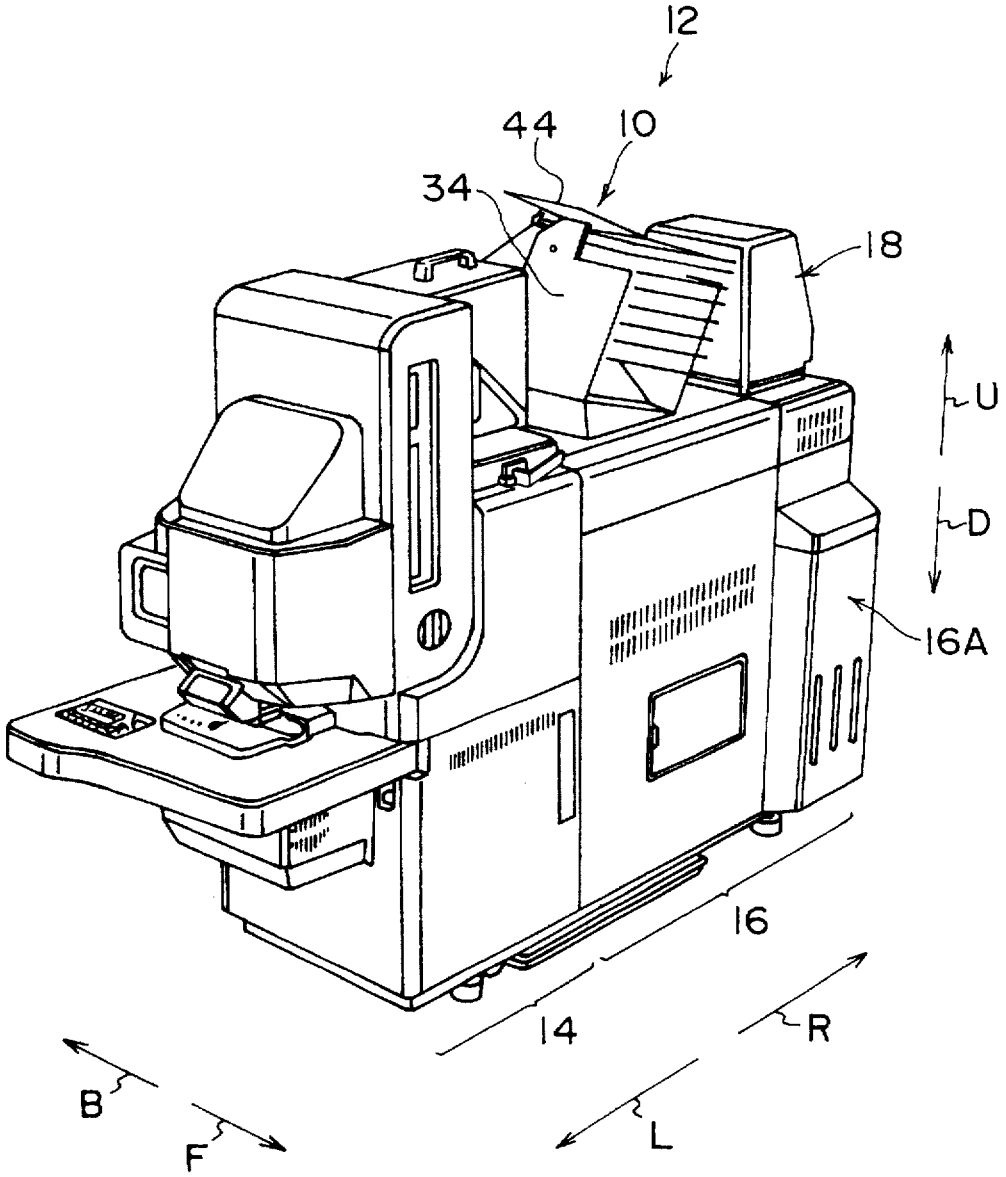
FIG. 2 is a perspective view of a print processor to which the sorting/conveying apparatus in accordance with the first embodiment of the present invention is applied.

FIG. 2 shows a printer processor 12 to which the present invention is applied. The print processor 12 is provided with a printer section 14 effecting printing as a main body and a processor section 16 for effecting development, fixing, washing, drying, and the like.

An elongated printing paper (not shown) which has been subjected to various processes, such as development, fixing, and washing, passes through the interior of a drying section 16A located on the right-hand side (on the side in the direction of arrow R in FIG. 2) of the processor section 16. The printing paper is then transported upward (in the direction of arrow U), and reaches a cutter section 18 projecting upward from an upper portion of the drying section 16A.

Figure 1:
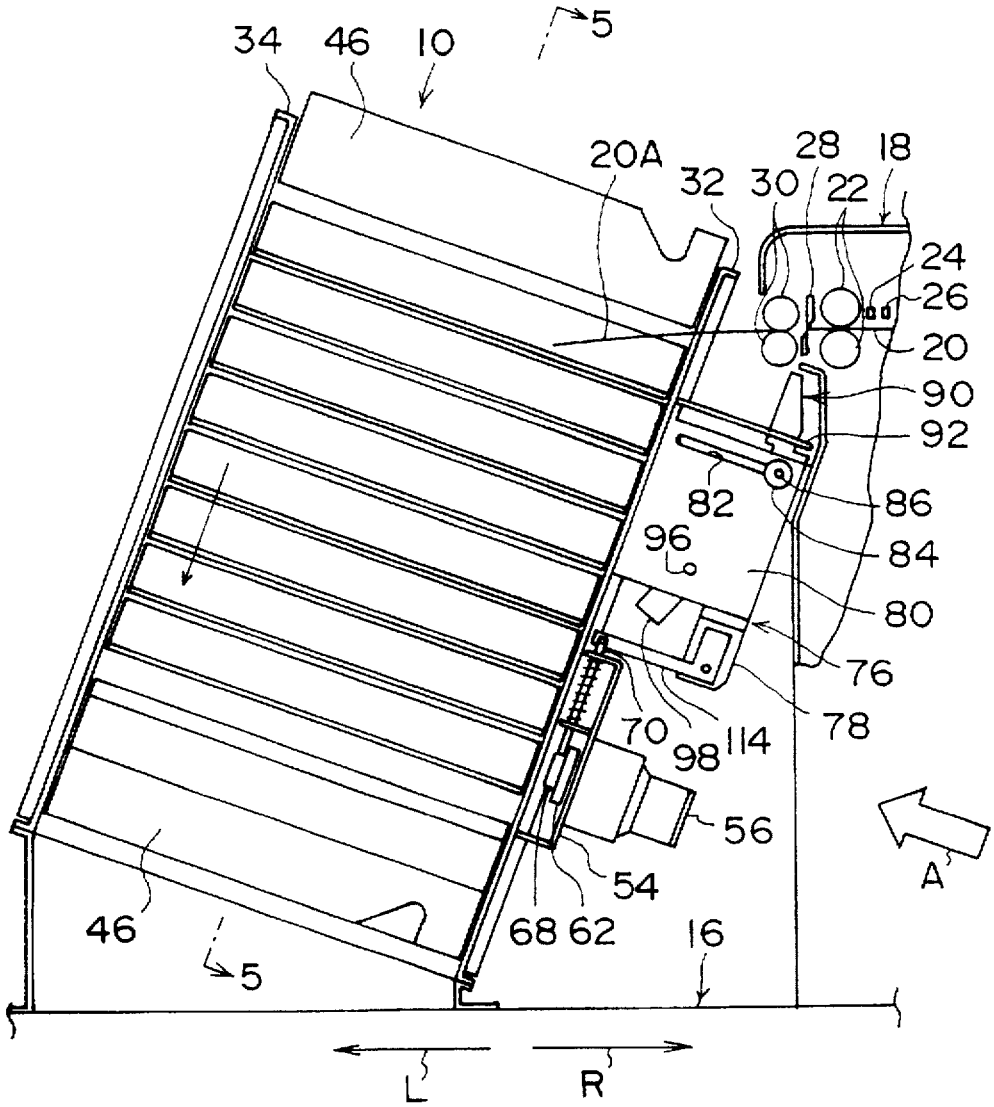
FIG. 1 is a front elevational view of a sorting/conveying apparatus in accordance with a first embodiment of the present invention.

As shown in FIG. 1, the cutter section 18 is provided with a pair of rollers 22 for conveying an elongated printing paper 20, a cut-hole sensor 24 for detecting cut holes (not shown) provided in the printing paper 20, a sort-hole sensor 26 for detecting sort holes (not shown) similarly provided in the printing paper 20, a cutter 28 for cutting the elongated printing paper 20 for each frame on the basis of signals from the sort-hole sensor 26 and the cut-hole sensor 24, and a pair of discharge rollers 30 serving as a discharging section. The pair of discharge rollers 30 is disposed on the upper left-hand side (on the side in the direction of arrow L) of the cutter section 18, and is adapted to discharge cut prints 20A, i.e., the cut photosensitive material, toward the left-hand side.

A sorting/conveying apparatus 10 is disposed on the left-hand side of the cutter section 18. The sorting/conveying apparatus 10 has a pair of side plates 32 and 34 which is inclined toward the cutter section 18 (in this embodiment, the pair of side plates 32 and 34 is inclined 20° with respect to the vertical direction).

Figure 3:
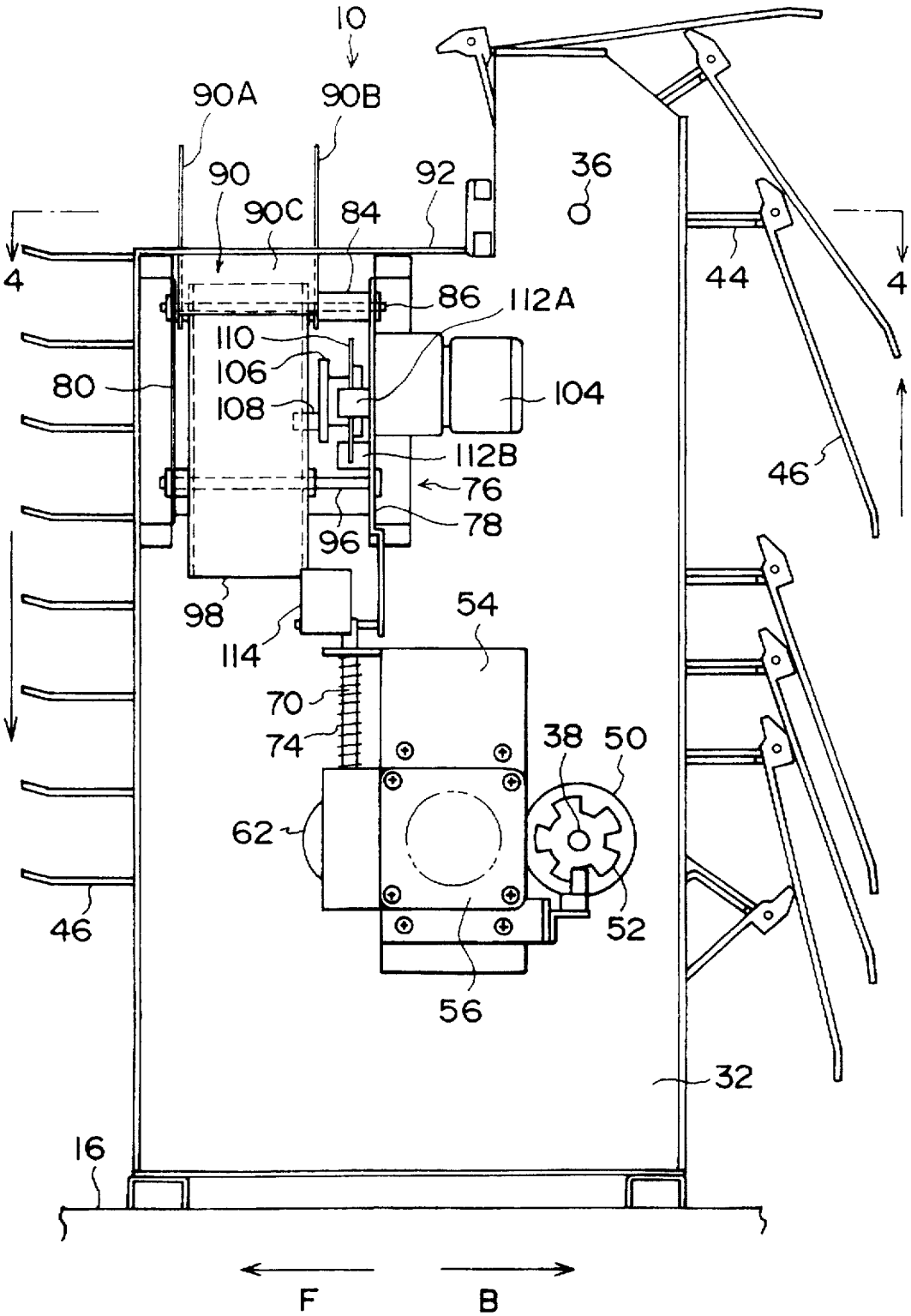
FIG. 3 is a view of the sorting/conveying apparatus taken in the direction of arrow A in FIG. 1.
Figure 4:
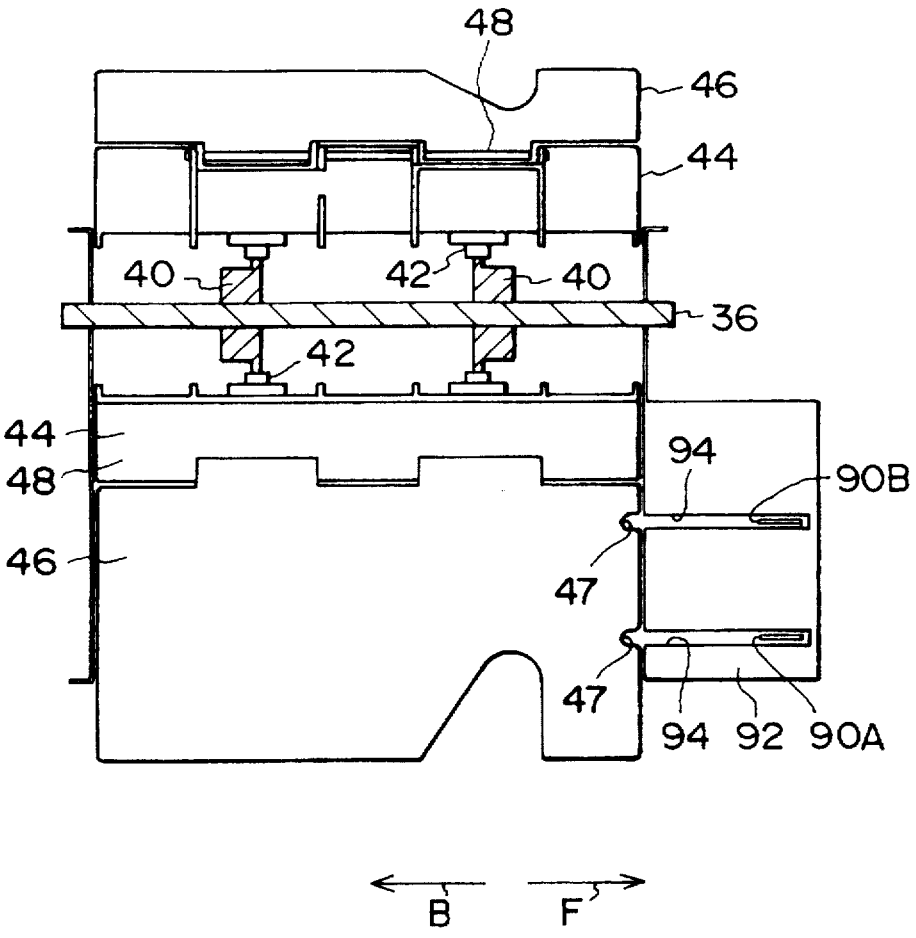
FIG. 4 is a cross-sectional view of the sorting/conveying apparatus taken along line 4—4 in FIG. 3.
Figure 5:
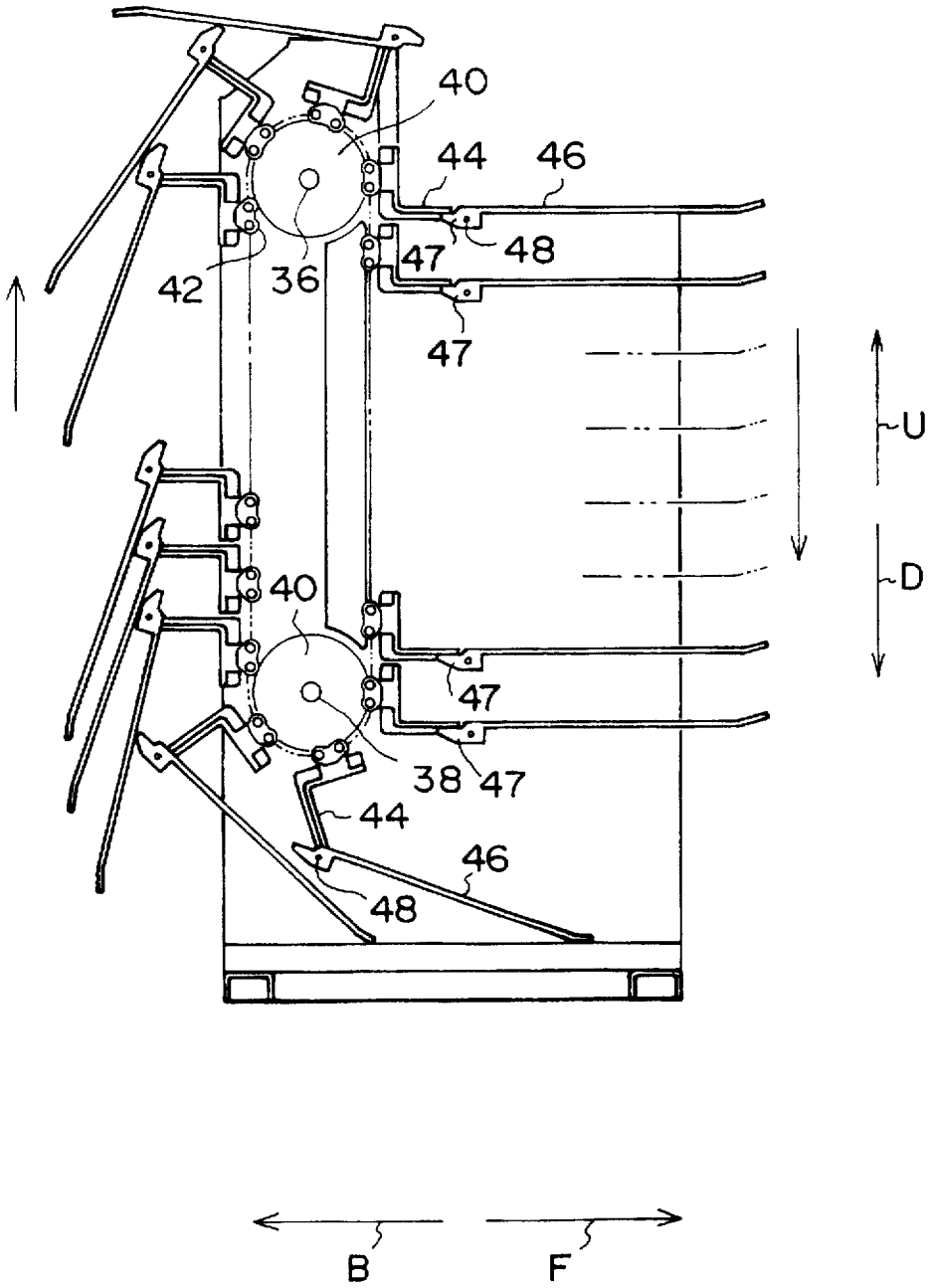
FIG. 5 is a cross-sectional view of the sorting/conveying apparatus taken along line 5—5 in FIG. 1.

As shown in FIGS. 3 and 4, a shaft 36 and a shaft 38 are respectively rotatably supported between the pair of side plates 32 and 34, the shaft 36 being located on the upper side and the shaft 38 being located on the lower side. As shown in FIGS. 4 and 5, a pair of sprockets 40 is attached, at a predetermined interval therebetween, to each of the shafts 36 and 38, and an endless chain 42 serving as an endlessly conveying section is trained between each pair of the sprocket 40 of the shaft 36 and the sprocket 40 of the shaft 38.

As shown in FIG. 5, L-shaped tray-supporting members 44 are attached to the endless chains 42 at predetermined intervals. A receiving tray 46 serving as a substantially flat, photosensitive-material receiving member for receiving the prints is attached to each of the tray-supporting members 44 by means of a hinge 48. The receiving tray 46 has a projecting portion 47 projecting slightly toward the endless chain 42 from the rotating center of the hinge 48. The arrangement provided is such that when the receiving tray 46 is located on the front side (on the side in the direction of arrow F) of the print processor 12, the projecting portion of the receiving tray 46 abuts against the lower side of the tray-supporting member 44, so that the receiving tray 46 becomes orthogonal to direction of the linear portion (i.e., the U- and D-directions) of the endless chain 42, preventing the rotation of the receiving tray 46. Meanwhile, when the receiving tray 46 is located on the rear side (on the side in the direction of arrow B) of the print processor 12, the receiving tray 46 rotates about the position where the hinge 48 is attached, and is thereby suspended downward (in the direction of arrow D).

Figure 6:
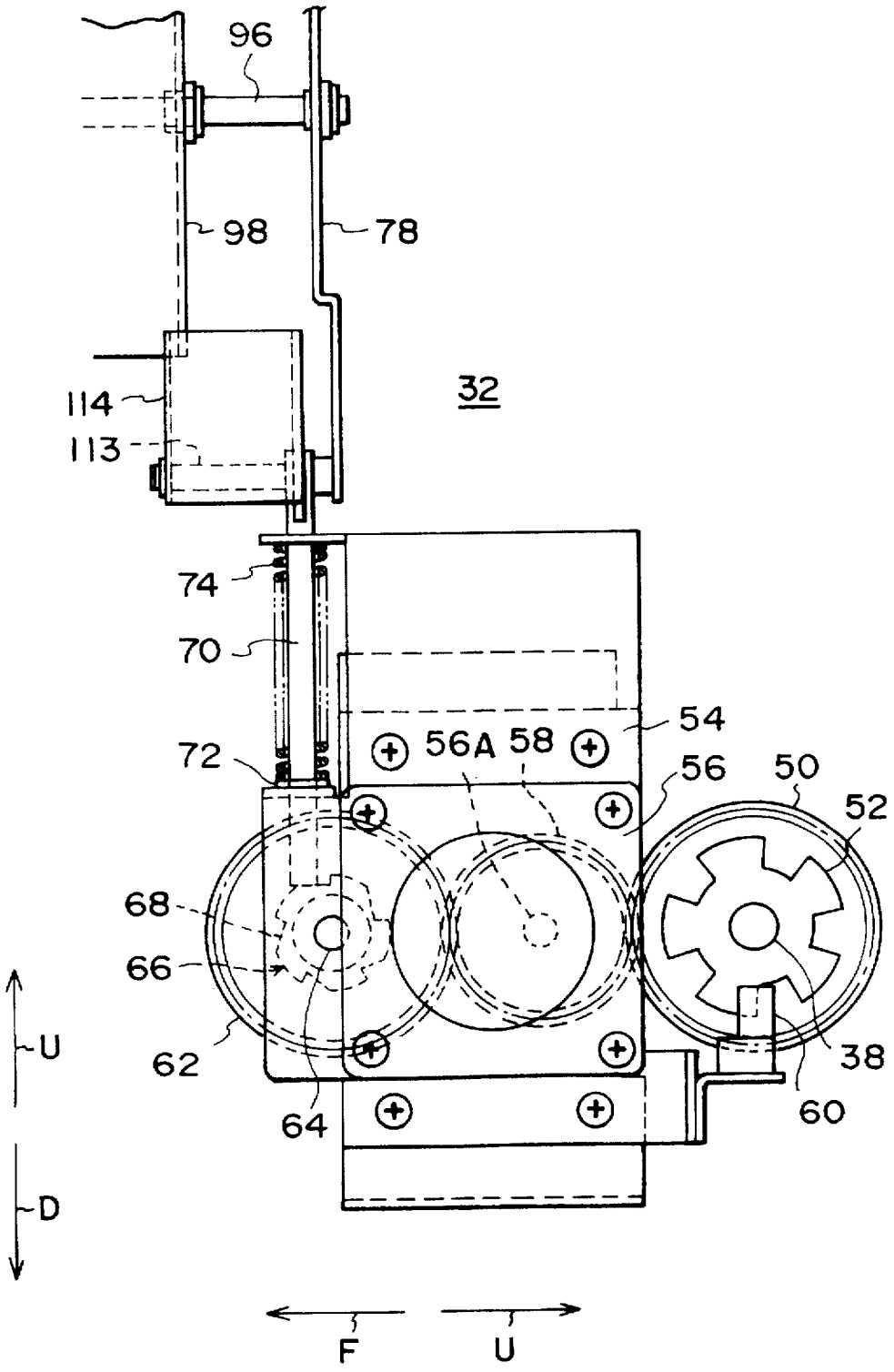
FIG. 6 is a partially enlarged view of FIG. 3.

One end of the lower shaft 38 is provided in such a manner as to project outside the side plate 32, and a gear 50 and a slit disk 52 are attached to the shaft 38 in that order from the side plate 32 side, as shown in FIGS. 3 and 6. The side plate 32 is provided with a geared motor 56 via an attaching frame 54, and a shaft 56A of the geared motor 56 is provided with a gear 58 meshing with the gear 50.

In addition, a transmission-type optical sensor 60 is attached to the attaching frame 54 in such a manner as to be located on both sides of the slit disk 52. Incidentally, the slit disk 52 is used to move the endless chains 42 by predetermined amounts. It should be noted that, in FIGS. 3 and 6, when the gear 50 rotates counterclockwise, the receiving trays 46 move vertically downward on the front side of the print processor 12 (on the side in the direction of arrow F), as shown in FIG. 5.

As shown in FIG. 6, a shaft 64 is fixedly secured to the attaching frame 54, and a gear 62 meshing with the gear 58 is rotatably supported by the shaft 64. A cam 66 is secured to a side surface of the gear 62 on the side plate 32 side. Substantially triangular notches 68 are formed on the outer periphery of the cam 66 at predetermined intervals in the circumferential direction.

In correspondence with the cam 66, a lock pin 70 is supported by the attaching frame 54 in such a manner as to be vertically movable toward or away from the cam 66. A ring 72 is secured to the longitudinally intermediate portion of the lock pin 70, and a coil spring 74 for urging the lock pin 70 toward the cam 66 is fitted over the outer periphery of the lock pin 70 in such a manner as to extend between the ring 72 and an upper end of the attaching frame 54.

When a lower end of the lock pin 70 is inserted into the notch 68 of the cam 66, the counterclockwise rotation of the cam 66 is prevented. Consequently, the counterclockwise rotation of the shaft 38 is prevented, with the result that the receiving trays 46 located on the front side (the side in the direction of arrow F) of the print processor 12 are prevented from moving downward.

As shown in FIGS. 1, 3, and 4, a print pushing-out device 76 serving as a pushing-out member is provided on the side plate 32 on the upper front side of the print processor 12. The print pushing-out device 76 has a pair of mutually parallel frames 78 and 80 whose planar direction is made orthogonal to the planar direction of the side plate 32. A placing plate 92, which serves as a placing member and is provided such that its planar direction is orthogonal to the planar direction of the side plate 32, is disposed on top of the frames 78 and 80.

As shown in FIGS. 3 and 4, a print pushing-out plate 90 is disposed between the frames 78 and 80. The print pushing-out plate 90 is comprised of a pair of side portions 90A and 90B which are parallel with the frames 78 and 80 as well as a connecting portion 90C connecting the side portions 90A and 90B. A pair of slits 94 are formed in the placing plate 92, and the side portions 90A and 90B of the print pushing-out plate 90 project through the slits 94 above the placing plate 92.

Figure 7:
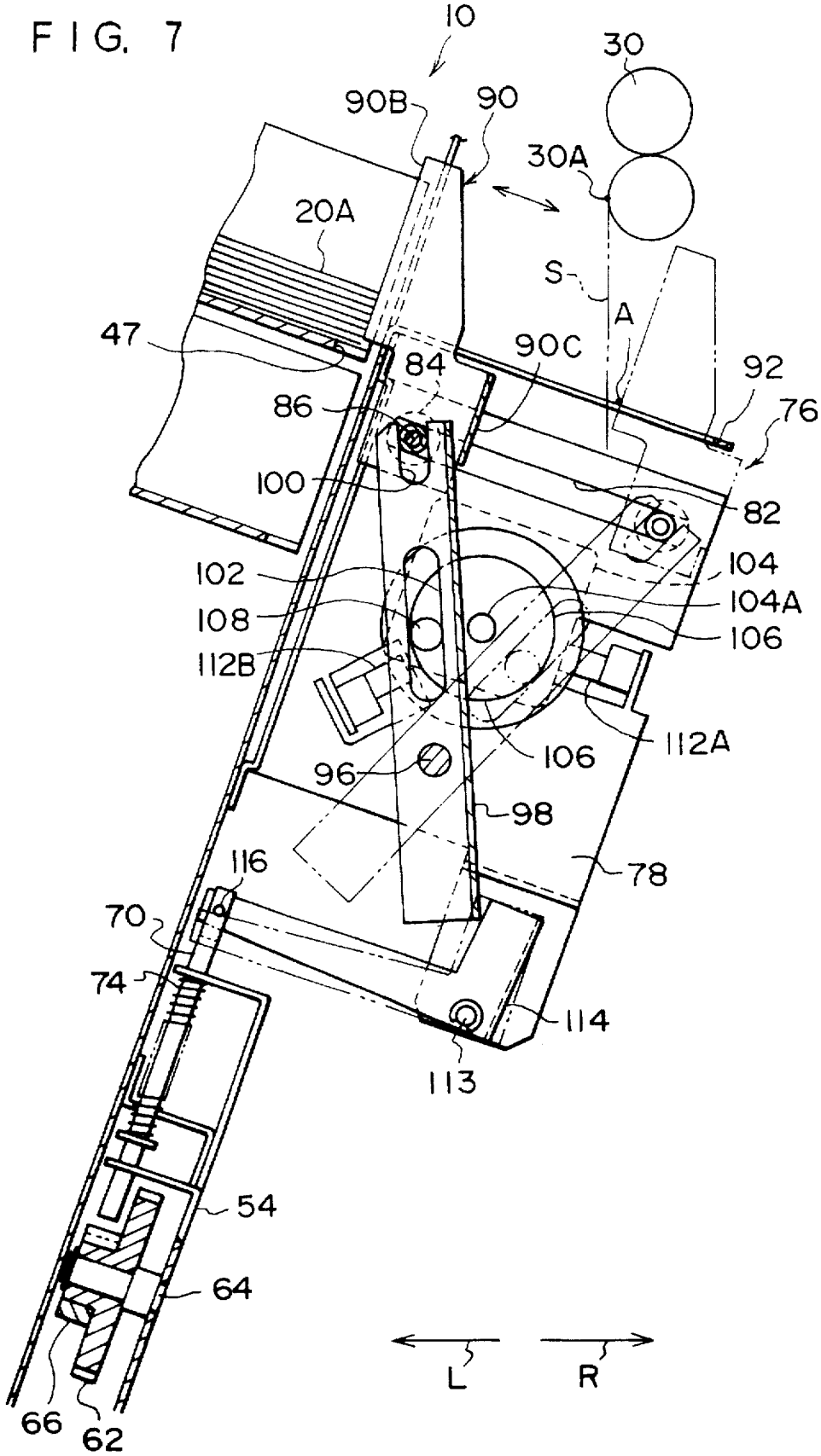
FIG. 7 is a cross-sectional view of a print pushing-out device and its vicinity of the sorting/conveying apparatus shown in FIG. 1.

As shown in FIGS. 1 and 7, a slit 82 extending in a direction orthogonal to the planar direction of the side plate 32 is formed in each of the frames 78 and 80. A shaft 86 is inserted in the slit 82 by means of a sliding member 84.

A hollow cylindrical portion and a pair of two-width portions (none are shown) are formed on the sliding member 84. One of the two-width portions is slidably inserted in the slit 82, while the other two-width portion is fitted in a square hole (not shown) formed in each of the side portions 90A and 90B of the print pushing-out plate 90.

As shown in FIGS. 7 and 3, a link 98 is swingably supported by the frames 78 and 80 by means of a shaft 96. As shown in FIG. 7, a groove 100 is formed in an upper end of the link 98, while an elongated hole 102 is formed in an intermediate portion thereof. The aforementioned hollow cylindrical portion of the sliding member 84 is slidably inserted in the groove 100.

A geared motor 104 is attached to the frame 78, and a disk 106 is attached to a rotating shaft 104A of the geared motor 104. A pin 108 is attached to the disk 106 at a position eccentric from the rotating shaft 104A, and the pin 108 is slidably inserted in the elongated hole 102 of the link 98.

Consequently, when the geared motor 104 rotates, the link 98 is swung about the shaft 96, so that the print pushing-out plate 90 moves along the slits 94 shown in FIG. 4 and provided in the placing plate 92.

In addition, a disk 110 having slits (not shown) formed therein is attached to the rotating shaft 104A of the geared motor 104. A pair of optical sensors 112A and 112B is attached to the frame 78 in such a manner as to be located on both sides of the disk 110. The disk 110 and the optical sensors 112A and 112B are used to determined the rotational angle of the rotating shaft 104A of the geared motor 104, and, hence, the stopping position of the print pushing-out plate 90.

As shown in FIGS. 7 and 6, a shaft 113 is secured to a lower end of the frame 78, and an L-shaped lever 114 is rotatably supported by the shaft 113. An upper end of the lock pin 70 is connected to one end of the lever 114 by means of a pin 116.

When the print pushing-out plate 90 has moved close to the side plate 32 (i.e., in the state shown in FIG. 7), a lower end of the link 98 abuts against the other end of the lever 114, which in turn causes one end of the lever 114 to pull the lock pin 70 upward against the urging force of the coil spring 74 (in the state shown by the solid lines in FIG. 7).

As shown in FIG. 7, when the print pushing-out plate 90 is moved to one extreme end on the endless chain 42 side (in the state shown by the solid lines in FIG. 7), the print pushing-out plate 90 is adapted to enter the inner side of the side plate 32 by a small amount. On the other hand, when the print pushing-out plate 90 is moved to the other extreme end on the cutter section side 18 (in the state shown by the phantom lines in FIG. 7), a point A of intersection between the side portions 90A and 90B on the one hand, and the placing plate 92 on the other, is located on the discharge roller 30 side with respect to a perpendicular line S which passes through an end 30A of the discharge roller 30 on the side plate 32 side.

Incidentally, as shown in FIGS. 4 and 7, the receiving tray 46 has a pair of escaping portions 47 formed therein, whereby the side portions 90A and 90B of the print pushing-out plate 90 are capable of pushing the cut print 20A to a predetermined position on the receiving tray 46 in such a way that the cut print 20A will not be caught by an end portion of the receiving tray 46.

Figure 8:
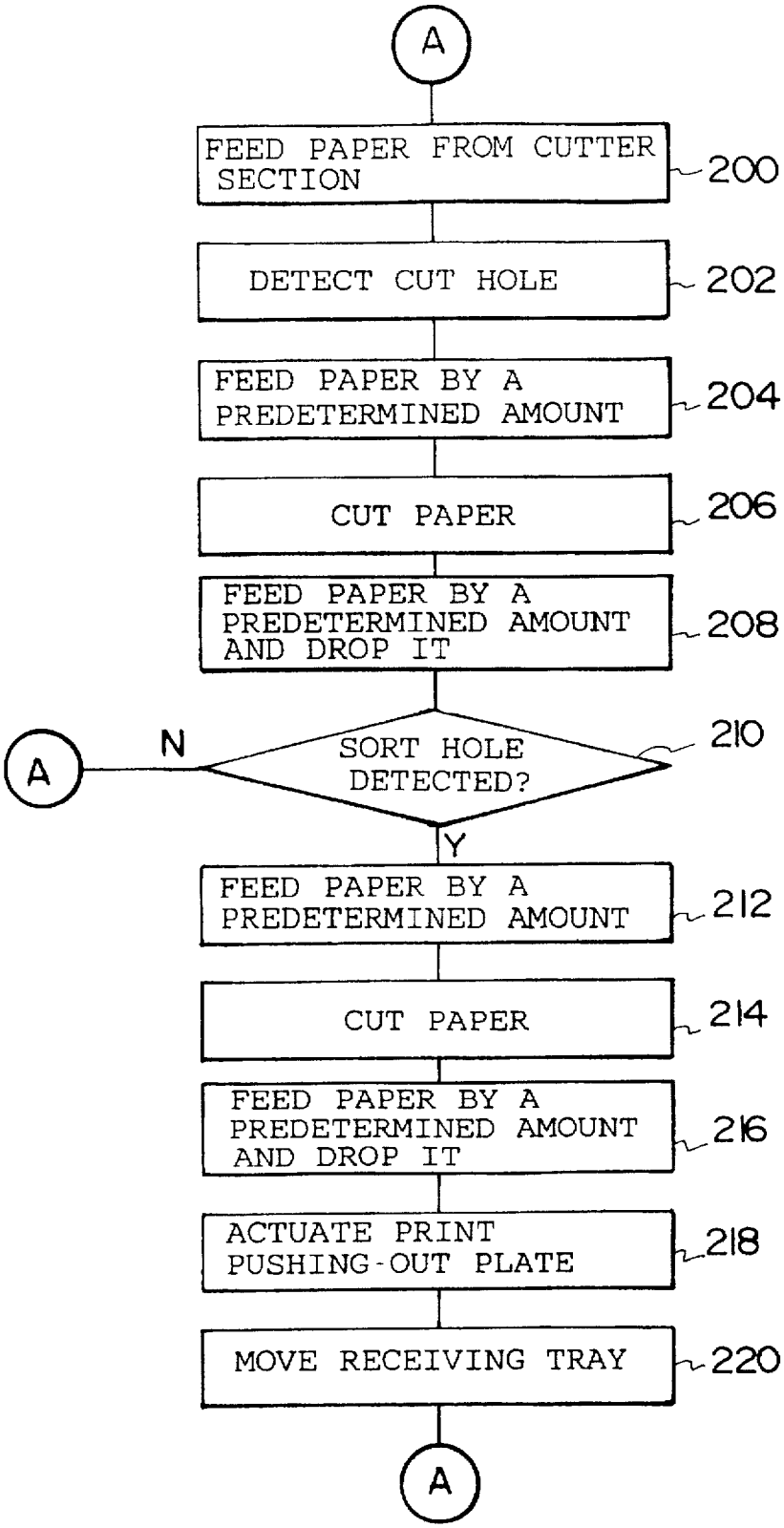
FIG. 8 is a flowchart explaining the operation of the first embodiment.

Next, a description will be given of the operation of the sorting/conveying apparatus 10 with reference to the flowchart shown in FIG. 8.

In Step 200, the elongated printing paper 20 subjected to dry processing is fed by the rollers 22 in the cutter section 18.

In Step 202, the cut hole is detected by the cut-hole sensor 24. In Step 204, the elongated printing paper 20 is fed out by a predetermined amount.

In Step 206, the cutter 28 operates to cut the printing paper 20.

In Step 208, the cut print 20A is fed by a predetermined amount by the discharge rollers 30, and drops onto the placing plate 92 and the receiving tray 46.

Incidentally, before the cut print 20A drops, the print pushing-out plate 90 is located on the cutter section 18 side (at the position shown by the phantom lines in FIG. 7), while the plane of the upper surface of the receiving tray 46 is parallel to but slightly lower than the plane of the upper surface of the placing plate 92.

Since the placing plate 92 and the receiving tray 46 are inclined such that the cutter section 18 side thereof is lower than the opposite side thereof, the cut print 20A on the placing plate 92 and the receiving tray 46 slides toward the cutter section 18 side, so that trailing ends of the cut prints 20A (ends thereof on the cutter section 18 side) abut against the side portions 90A and 90B of the print pushing-out plate 90 and are arranged thereby.

Here, since the point A of intersection between the side portions 90A and 90B on the one hand, and the placing plate 92 on the other, is located on the cutter section 18 side with respect to the perpendicular line S which passes through the end 30A of the discharge roller 30 on the side plate 32 side, even if the cut prints 20A are dropped straightly downward, the cut prints 20A are accumulated in parallel on the placing plate 92. In addition, since the side plate 32-side ends of the side portions 90A and 90B are inclined toward the cutter section 18, even if the discharged cut prints 20A are dropped by being offset slightly toward the cutter section 18, the cut prints 20A can be accumulated in parallel on the receiving tray 46 and the placing plate 92 with their trailing ends arranged by being guided by the side portions 90A and 90B.

In Step 210, a determination is made as to whether or not the sort hole (not shown) in the printing paper 20 has been detected by the sort-hole sensor 26. If the sort sensor has not been detected, the operation returns to Step 200 to repeat the above-described processing, and the plurality of cut prints 20A are consecutively accumulated on the receiving tray 46 and the placing plate 92 with their trailing ends arranged.

If the sort hole in the printing paper 20 is detected in Step 210, the operation proceeds to Step 212 in which the elongated printing paper 20 is fed by a predetermined amount.

In Step 214, the cutter 28 operates to cut a final print of a one-order portion out of the printing paper 20.

In Step 216, the discharge rollers 30 rotate by a fixed amount to allow the final cut print 20A of the order to be discharged and dropped. In this way, the one-order portion of prints is stacked on the receiving tray 46 and the placing plate 92.

In Step 218, the geared motor 104 is driven to cause the print pushing-out plate 90 to push the one-order portion of the accumulated prints onto the receiving tray 46.

In Step 220, the motor 56 is driven to move the tray 46 downward.

Thereafter, insofar as there is an oncoming portion of the printing paper 20 subjected to dry processing, the above-described processing is repeated, and each receiving tray 46 with each one-order portion of cut prints 20A accumulated thereon is consecutively conveyed downward.

After the cut prints 20A are stacked, the print pushing-out plate 90 moves toward the cutter section 18 side, and the lock pin 70 abuts against the notch 68 of the cam 66 to prevent the counterclockwise rotation of the gear 62, as shown by the phantom lines in FIG. 7 and the solid lines in FIG. 6, thereby preventing the movement of the endless chains 42. As a result, even if the cut prints 20A have been accumulated and the load is thereby offset, the receiving trays 46 are prevented from moving unexpectedly.

With the sorting/conveying apparatus 10, since the conveying direction is inclined, in a case where conveyance is effected over the same heightwise dimension, the conveying distance can be made longer than that of the conventional sorting/conveying apparatus in which the conveying direction is vertical. Namely, the sorting/conveying apparatus t0 in accordance with this embodiment can be provided with a larger number of receiving trays 46 than the conventional sorting/conveying apparatus, thereby making it possible to cope with a larger number of orders than the conventional sorting/conveying apparatus.

In addition, although heat from the drying section 16A is radiated from the cutter section 18 side, since the sorting/conveying apparatus 10 is gradually inclined away from the cutter section 18 side, it is possible to move the accumulated cut prints 10A away from the effect of heat, thereby making it possible to prevent unwanted curls and the like.

Second Embodiment

Figure 9:
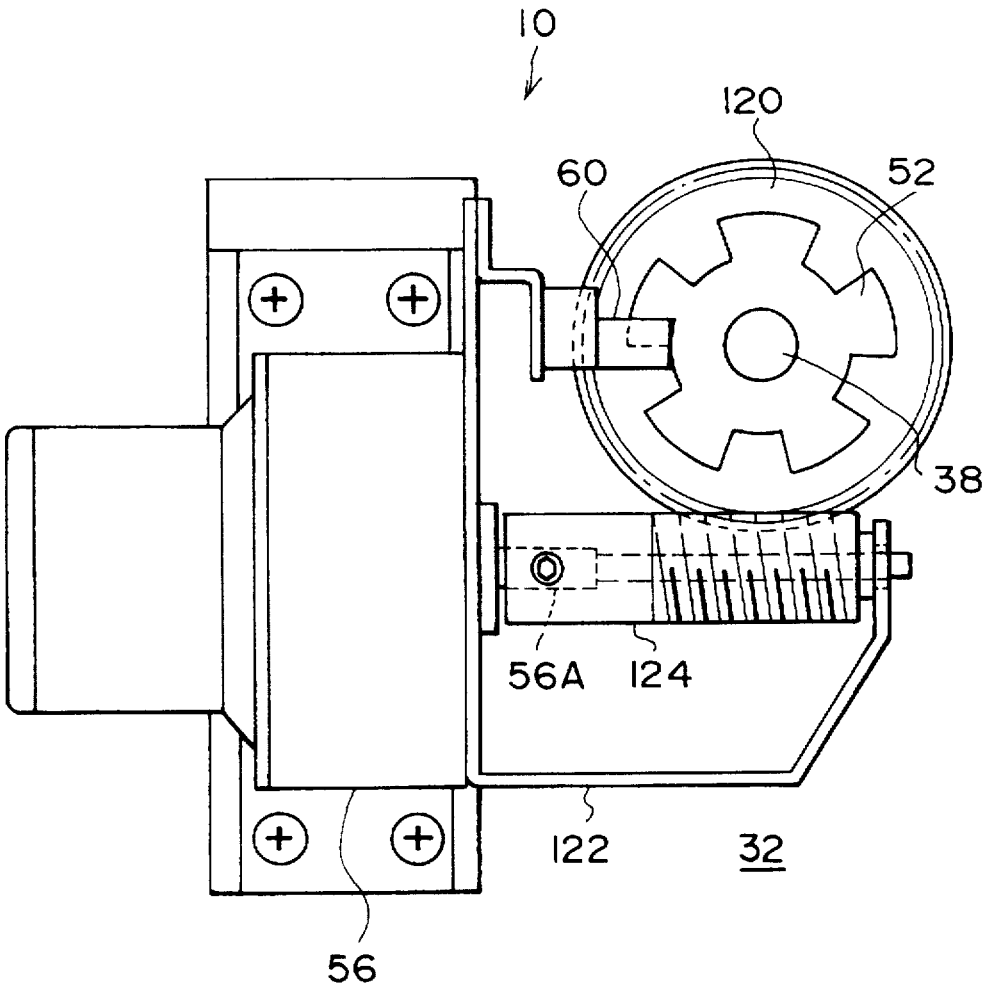
FIG. 9 is a partially enlarged view of a sorting/conveying apparatus in accordance with a second embodiment of the present invention and corresponds to FIG. 3.

Referring now to FIG. 9, a description will be given of a second embodiment of the present invention. Incidentally, the same component parts and arrangements as those of the first embodiment will be denoted by the same reference numerals, and a description thereof will be omitted.

As shown in FIG. 9, in the sorting/conveying apparatus 10 of this embodiment, a worm wheel 120 and the slit disk 52 are attached to one end of the lower shaft 38 in that order. The geared motor 56 is attached to the side plate 32 by means of an attaching frame 122, while a worm gear 124 meshing with the worm wheel 120 is attached to the shaft 56A of the geared motor 56. Additionally, the transmission-type optical sensor 60 is attached to the attaching frame 122 in such a manner as to be located on both sides of the slit disk 52.

In this embodiment, as the worm gear 124 is rotated by the geared motor 56, the worm wheel 120 is rotated, which makes it possible to move the receiving trays 46 (not shown in FIG. 9) in the same way as in the first embodiment. In addition, since the worm wheel 120 meshes with the worm gear 124, even if the cut prints 20A are accumulated on the receiving trays 46, and a rotating force acts on the shaft 38, the worm wheel 120 is prevented from rotating unexpectedly.

In the above-described first embodiment, the unnecessary rotation of the shaft 38 is prevented by a large number of components including the lever 114, the lock pin 70, the coil spring 74, the gear 62, the cam 66, and the like. In this embodiment, however, the unnecessary rotation of the shaft 38 can be prevented by a simple arrangement comprising the worm wheel 120 and the worm gear 124, so that the structure, assembly, and the like can be made simpler than in the case of the sorting/conveying apparatus 10 of the first embodiment, thereby permitting a reduction in cost.

Figure 15:
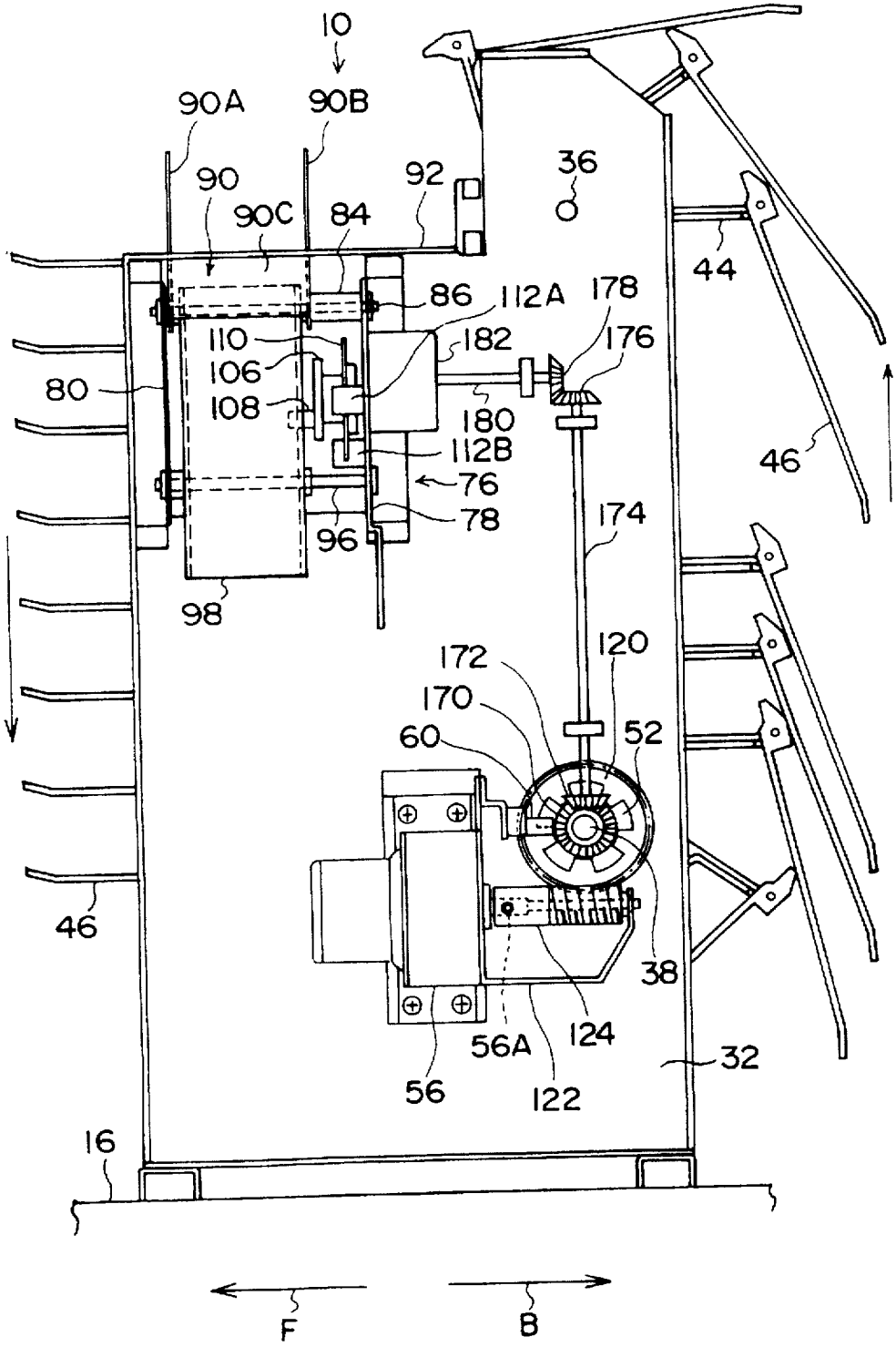
FIG. 15 is a modification of the sorting/conveying apparatus in accordance with the second embodiment of the present invention.

Although, in the second embodiment, the chains 42 and the print pushing-out plate 90 are driven by separate motors, the chains 42 and the print pushing-out plate 90 can be driven by a single motor. In this case, it suffices if, as shown in FIG. 15, a bevel gear 170 is attached to an end of the shaft 38, and the rotating force of the geared motor 56 is transmitted to the disk 106 via a bevel gear 172, a transmission shaft 174, a bevel gear 176, a bevel gear 178, a transmission shaft 180, and a reduction gear (a sector gear, a cam mechanism, or the like) 182.

Third Embodiment

Referring now to FIGS. 10 to 13, a description will be given of a third embodiment of the present invention. Incidentally, the same component parts and arrangements as those of the first embodiment will be denoted by the same reference numerals, and a description thereof will be omitted.

Figure 11:
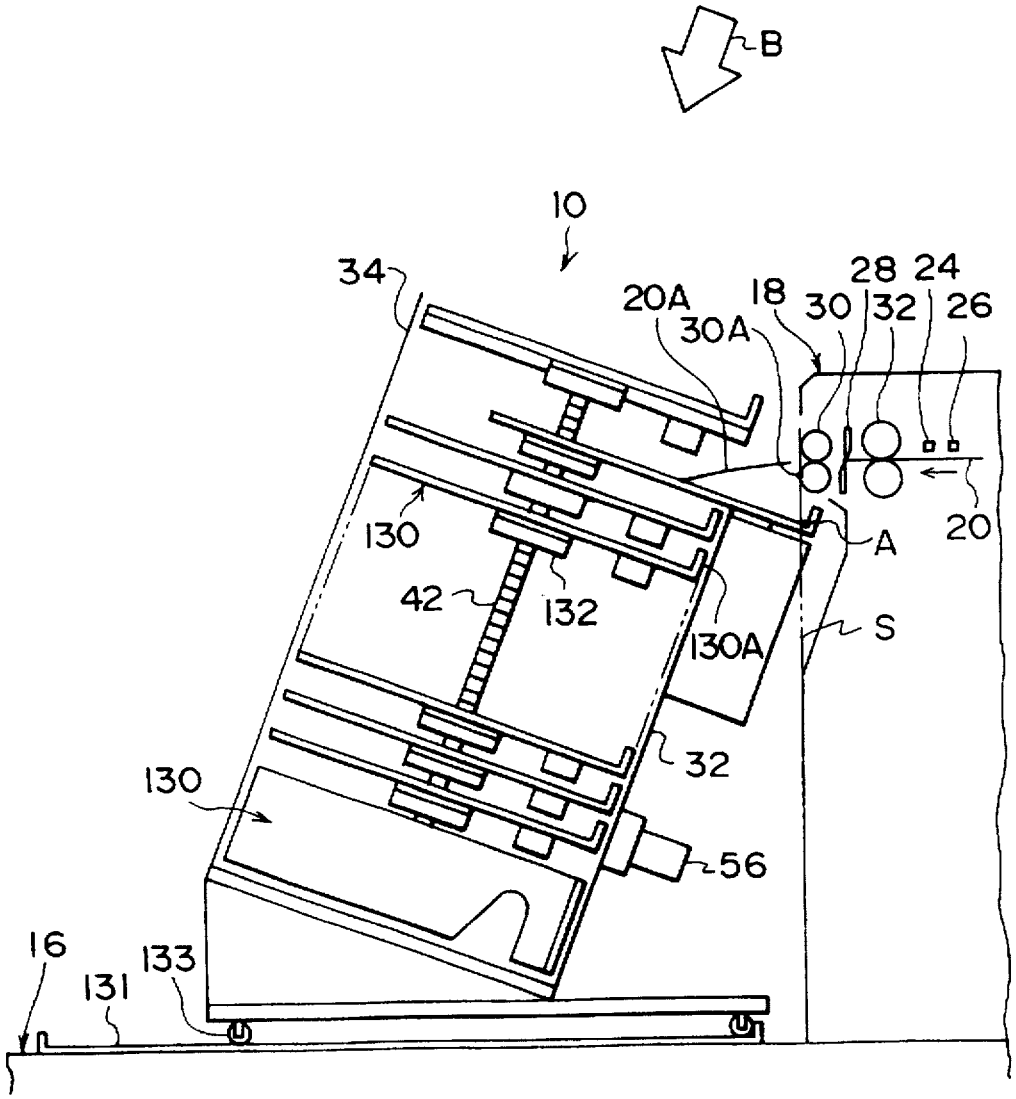
FIG. 11 is a front view of the sorting/conveying apparatus in accordance with the third embodiment of the present invention.

As shown in FIG. 11, wheels 133 are attached to the underside of the sorting/conveying apparatus 10 of this embodiment, and the wheels 133 engage a pair of rails 131 provided on the upper surface of the processor section 16. For this reason, as the sorting/conveying apparatus 10 can be moved over the processor section 16, it is possible to open various inspection ports, covers, and the like (none are shown) provided on the upper surface of the processor section 16, thereby facilitating maintenance and inspection.

Figure 10:
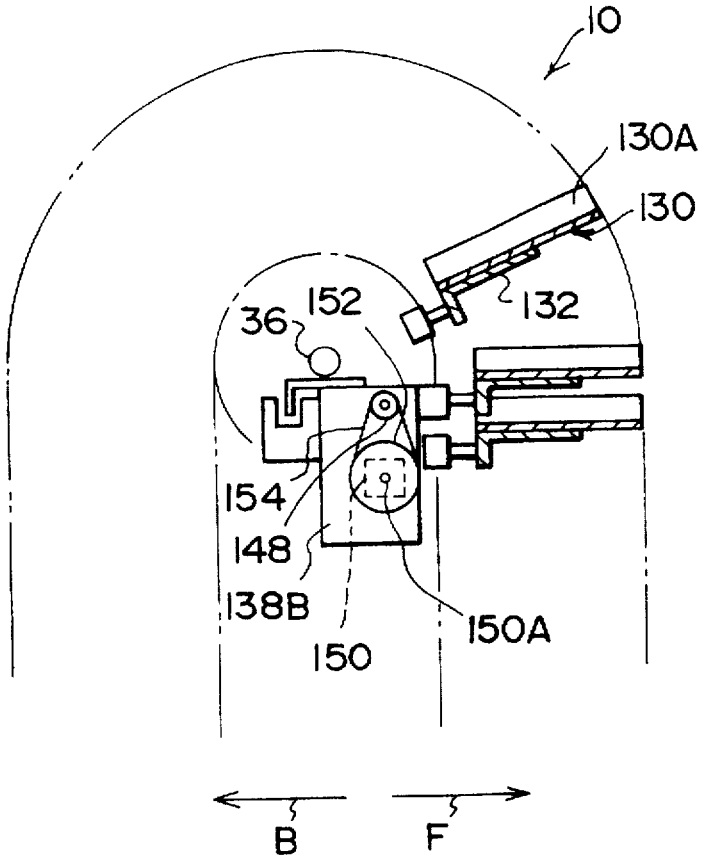
FIG. 10 is a vertical cross-sectional view of a sorting/conveying apparatus in accordance with a third embodiment of the present invention.

As shown in FIGS. 10 and 11, in the sorting/conveying apparatus 10, receiving trays 130 serving as photosensitive-material receiving members are supported by the chains 42 by means of L-shaped tray bases 132 and linear slide bearings (not shown), and are slidable to outside the side plate 32 by the linear slide bearings serving as sliding means.

Figure 12:
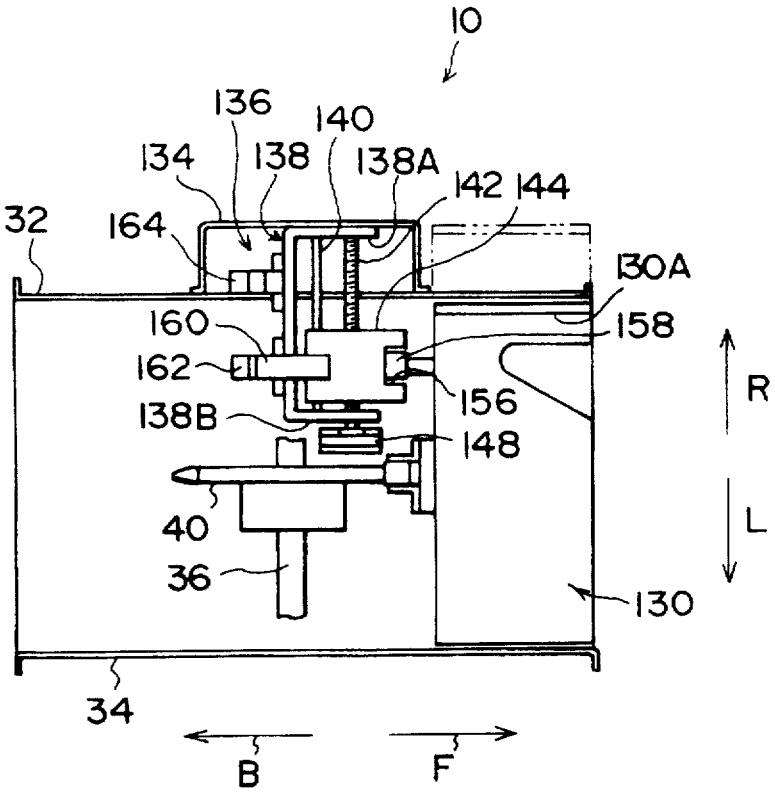
FIG. 12 is a view of the sorting/conveying apparatus taken in the direction of arrow B in FIG. 11.

In addition, the receiving tray 130 and the tray base 132 are connected to each other by an unillustrated extension spring, and each receiving tray 130 is disposed on the inner side of the side plate 32 by being normally pulled by the extension spring (in the state shown by the solid lines in FIG. 12).

The receiving tray 130 has an upright wall portion 130A provided on the cutter section 18 side, as shown in FIG. 11.

As shown in FIG. 12, a tray driving mechanism 136 serving as a driving member is attached to the side plate 32 via a frame 134. The tray driving mechanism 136 has a substantially rectangular frame 138, and a shaft 140 and a feed screw 142 are rotatably supported by a pair of side portions 138A and 138B of the frame 138. The shaft 140 and the feed screw 142 are made parallel to each other, and their axes are disposed orthogonally to the planar direction of the side plate 32.

Figure 13:
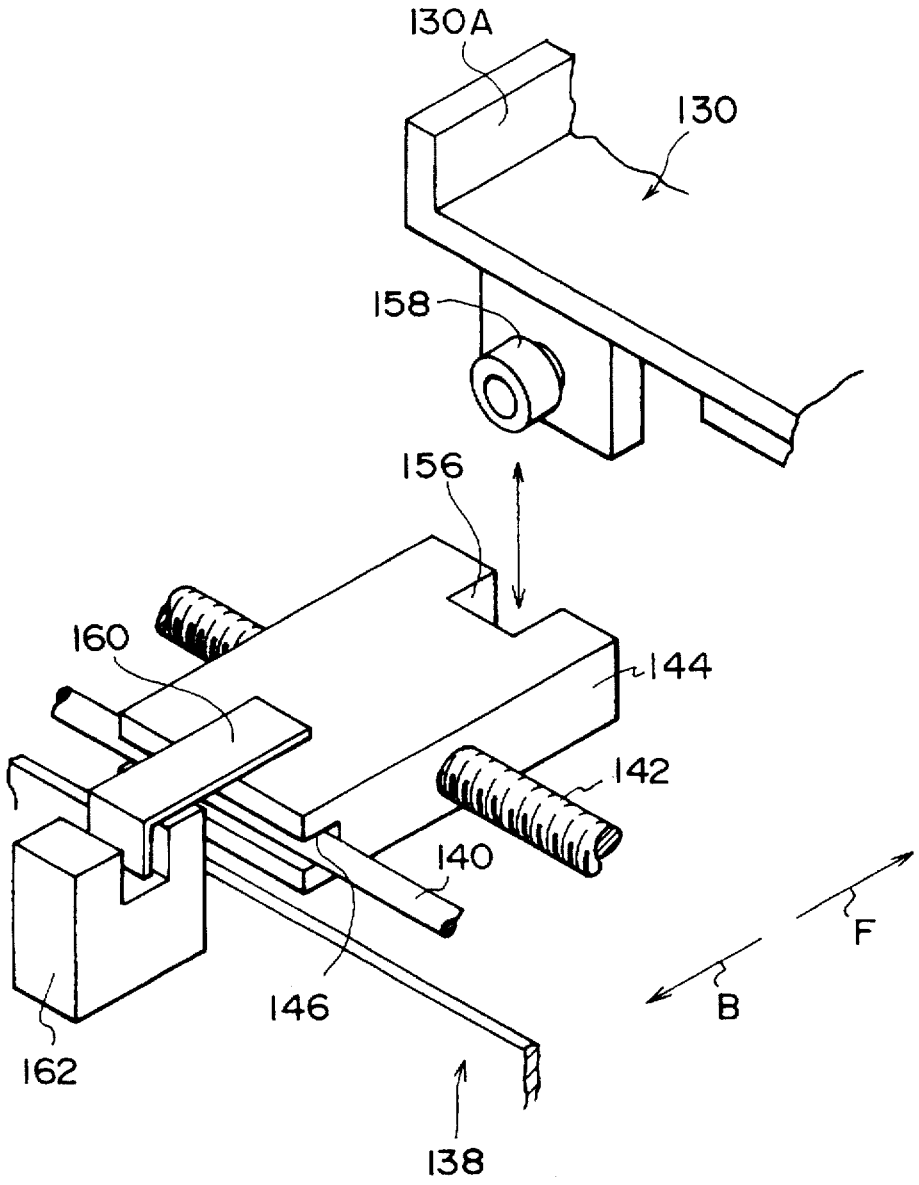
FIG. 13 is a perspective view of a moving block and its vicinity.

A moving block 144 is disposed between the side portion 138A and the side portion 138B. As shown in FIG. 13, an internal thread (not shown) is formed in an intermediate portion of the moving block 144, while a narrow groove 146 is formed at one end of the moving block 144 in parallel to the internal thread. The feed screw 142 is threadedly engaged in the internal thread, while the shaft 140 is inserted in the narrow groove 146.

As shown in FIGS. 10 and 12, one end of the feed screw 142 projects outside the side portion 138B, and a small pulley 148 is attached thereto. A motor 150 is attached to the side portion 138B, and a large pulley 152 is attached to a shaft 152A of the motor 150. An endless belt 154 is trained between the small pulley 148 and the large pulley 152.

As shown in FIGS. 12 and 13, a notch 156 is formed at the other end of the moving block 144. Meanwhile, a roller 158, which is inserted in the notch 156 of the moving block 144, is attached to the reverse surface (i.e., the surface opposite to the surface where the upright wall portion 130A projects) of the receiving tray 130.

In this embodiment, if the roller 158 of the receiving tray 130 is inserted in the notch 156 of the moving block 144, and the moving block 144 is moved toward the cutter section 18 side (i.e., in the R direction), the receiving tray 130 can be made to project outside the side plate 32 (see the state shown by the phantom lines in FIG. 12).

A substantially L-shaped light shielding plate 160 is attached to the moving block 144. The arrangement provided is such that in a case where the receiving tray 130 is located on the inner side of the side plate 32 (shown by the solid lines in FIG. 12), the light shielding plate 160 shields light from a transmission-type optical sensor 162, whereas in a case where the upright wall portion 130A side projects outside the side plate 32 by a predetermined amount (shown by the phantom lines in FIG. 12), the light shielding plate 160 shields light from a transmission-type optical sensor 164.

As shown in FIG. 11, in this embodiment, when the receiving tray 130 projects outside the side plate 32, the inner corner portion (point A) of the upright wall portion 130A of the receiving tray 130 is located on the cutter section 18 side with respect to the vertical line S passing through the side plate 32-side end 30A of the discharge roller 30. Therefore, even if the cut prints 20A drop vertically downward, the cut prints 20A are accumulated in parallel on the receiving tray 130.

In addition, since the upright wall portion 130A is inclined toward the cutter section 18 side, even if the discharged cut prints 20A are dropped by being offset slightly toward the cutter section 18, the cut prints 20A can be accumulated in parallel on the receiving tray 130 with their trailing ends arranged by being guided by the upright wall portion 130A.

Since each receiving tray 130 is inclined, the cut prints 20A which drop are slid toward the upright wall portion 130A, and abut against the upright wall portion 130A with their trailing ends arranged.

When a one-order portion of cut prints 20A is stacked on the receiving tray 130, the moving block 144 moves so as to return the receiving tray 130 toward the inner side of the side plate 32.

Next, the chains 42 move, so that the roller 158 of the receiving tray 130 with the cut prints 20A stacked thereon is removed from the notch 156 of the moving block 144. The receiving tray 130 whose roller 158 is removed from the moving block 144 is pulled toward the side plate 34 by the extension spring, and its position is maintained as it is.

Incidentally, since the conveying direction is inclined in the same way as the sorting/conveying apparatus 10 of the first embodiment, the sorting/conveying apparatus 10 in accordance with this embodiment is also capable of coping with a larger number of orders than the conventional sorting/conveying apparatus. Also, since the sorting/conveying apparatus 10 is gradually inclined away from the cutter section 18 side, it is possible to move the stacked cut prints 10A away from the effect of heat radiated from the drying section 16A, thereby making it possible to prevent unwanted curls and the like.

Fourth Embodiment

Referring now to FIGS. 16 to 24, a description will be given of a fourth embodiment of the present invention. Incidentally, the same component parts and arrangements as those of the foregoing embodiments will be denoted by the same reference numerals, and a description thereof will be omitted.

Figure 16:
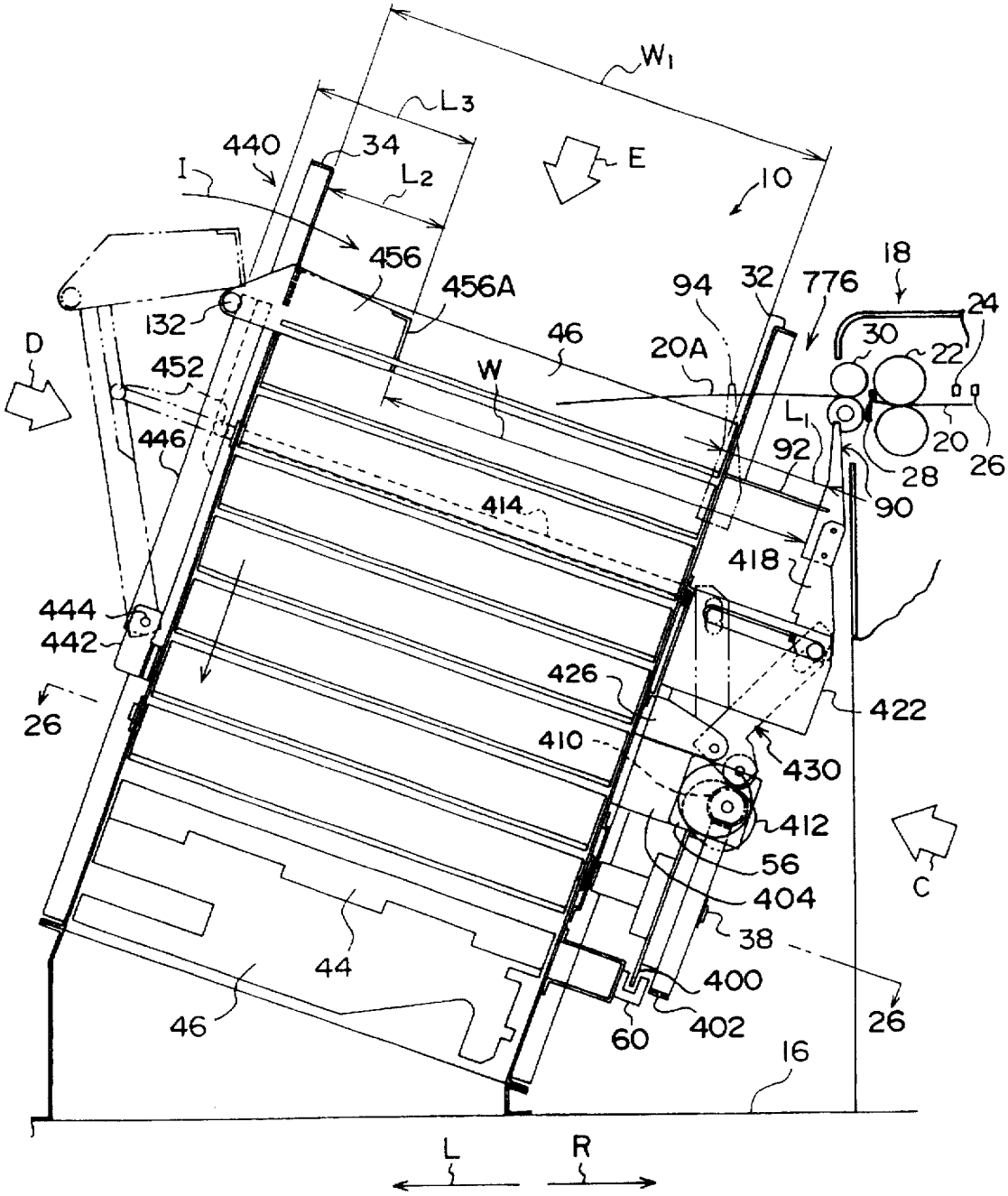
FIG. 16 is a front view of a sorting/conveying apparatus in accordance with a fourth embodiment of the present invention.
Figure 17:
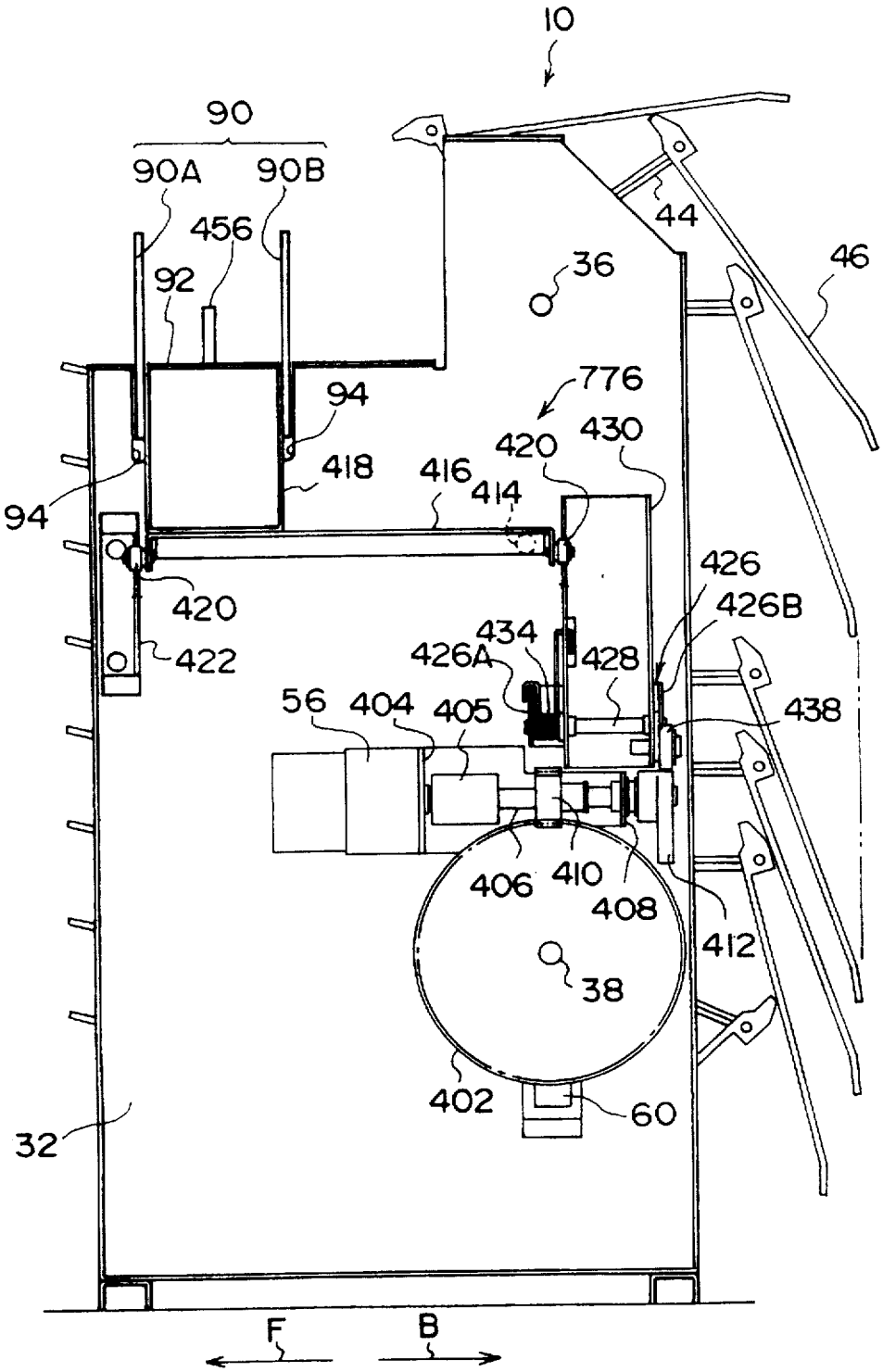
FIG. 17 is a view of the sorting/conveying apparatus taken in the direction of arrow C in FIG. 16.

As shown in FIGS. 16 and 17, in the print pushing-out device 76 of this embodiment, a slit disk 400 and a worm wheel 402 are attached to an end of the shaft 38 projecting outside the side plate 32.

The slit disk 400 functions in a manner similar to that of the slit disk 52 used in the foregoing embodiments, and the transmission-type optical sensor 60 is attached to the side plate 32 in such a manner as to be located on both sides of the slit disk 400.

The geared motor 56 is attached to the side plate 32 by means of an attaching frame 404, and the shaft (not shown of the geared motor 56 is disposed substantially perpendicularly to the axial direction of the shaft 38.

One end of a shaft 406 is connected to the shaft of the geared motor 56 by means of a coupling 405, and a portion of the shaft 406 in the vicinity of the other end thereof is rotatably supported by a support fitting 408 attached to the side plate 32.

A worm gear 410 meshing with the worm wheel 402 is attached to an intermediate portion of the shaft 406, while a can 412 is attached to the other end of the shaft 406.

Incidentally, the worm wheel 402 is rotatable counter-clockwise in FIG. 17 by the geared motor 56, and the receiving trays 46 are adapted to move downward on the front side (on the side in the direction of arrow F) of the print processor 12.

In this embodiment, the movement of the endless chains 42 is controllable by the slit disk 400 and the optical sensor 60.

As shown in FIGS. 16 and 17, a print pushing-out device 776 serving as a pushing-out member is provided on the side plate 32 on the upper front side of the print processor 12. The print pushing-out device 776 has the placing plate 92 arranged orthogonally to the side plate 32. This placing plate 92 is located at a position to which the cut prints 20A discharged from the cutter section 18 drop.

Figure 20:
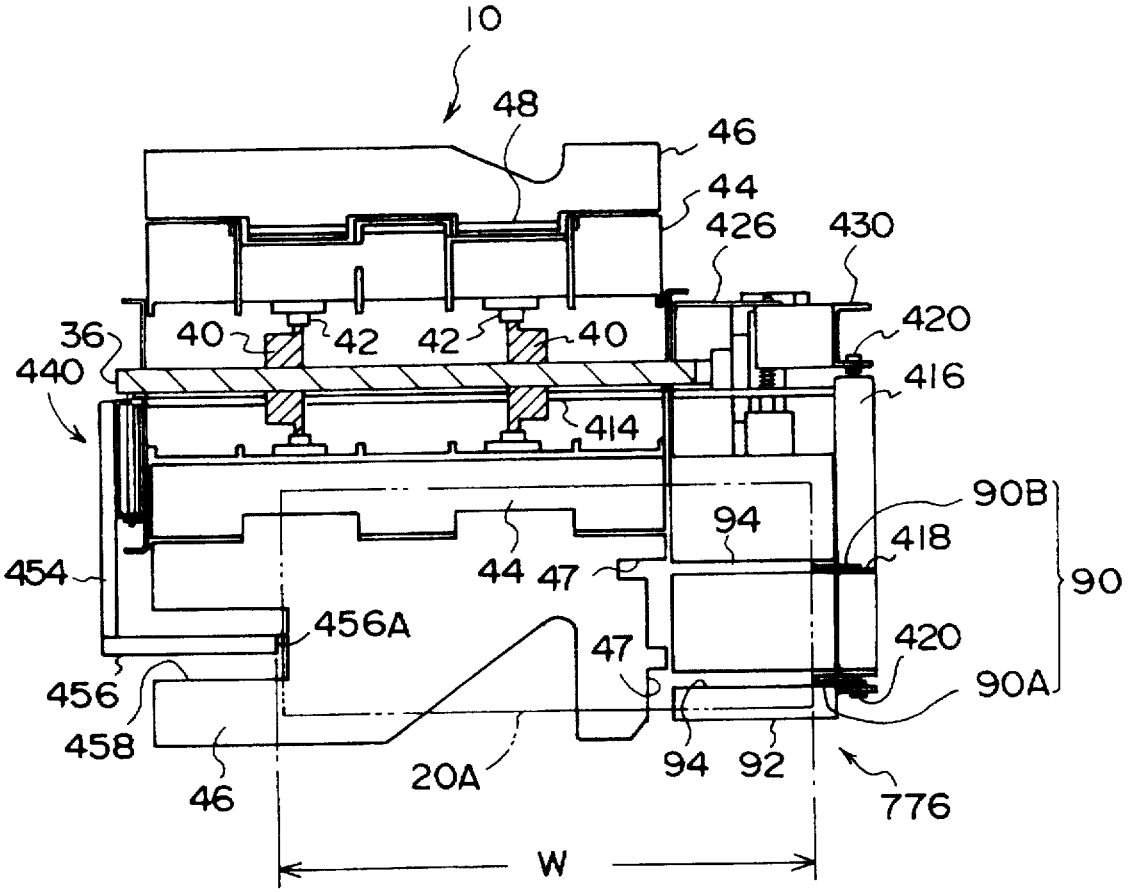
FIG. 20 is a partly sectional view of the sorting/conveying apparatus taken in the direction of arrow E in FIG. 16.

As shown in FIGS. 16, 17, and 20, a slide shaft 414 is provided below the shaft 36 in parallel to the shaft 36. The slide shaft 414 has both ends projecting outside the side plates 32 and 34 through holes (not shown) formed in the side plates 32 and 34. Incidentally, bearing bushes (not shown) for supporting the slide shaft 414 are fitted in the respective holes formed in the side plates 32 and 34, so as to facilitate the sliding of the slide shaft 414.

An elongated moving member 416 formed of a metal plate is fixed to an end of the slide shaft 414 projecting outside the side plate 32.

As shown in FIG. 17, a bracket 418 having a substantially U-shaped cross section is attached to an upper surface of the moving member 416, and the side portions 90A and 90B are fixed to the bracket 418. In addition, a small bearing 420 is attached to each end of the moving member 416.

A frame 422, which is located below the placing plate 92 orthogonally to the planar directions of the side plate 32 and the placing plate 92, is attached to the outer surface of the side plate 32 on the front side (on the side in the direction of arrow F).

Figure 18:
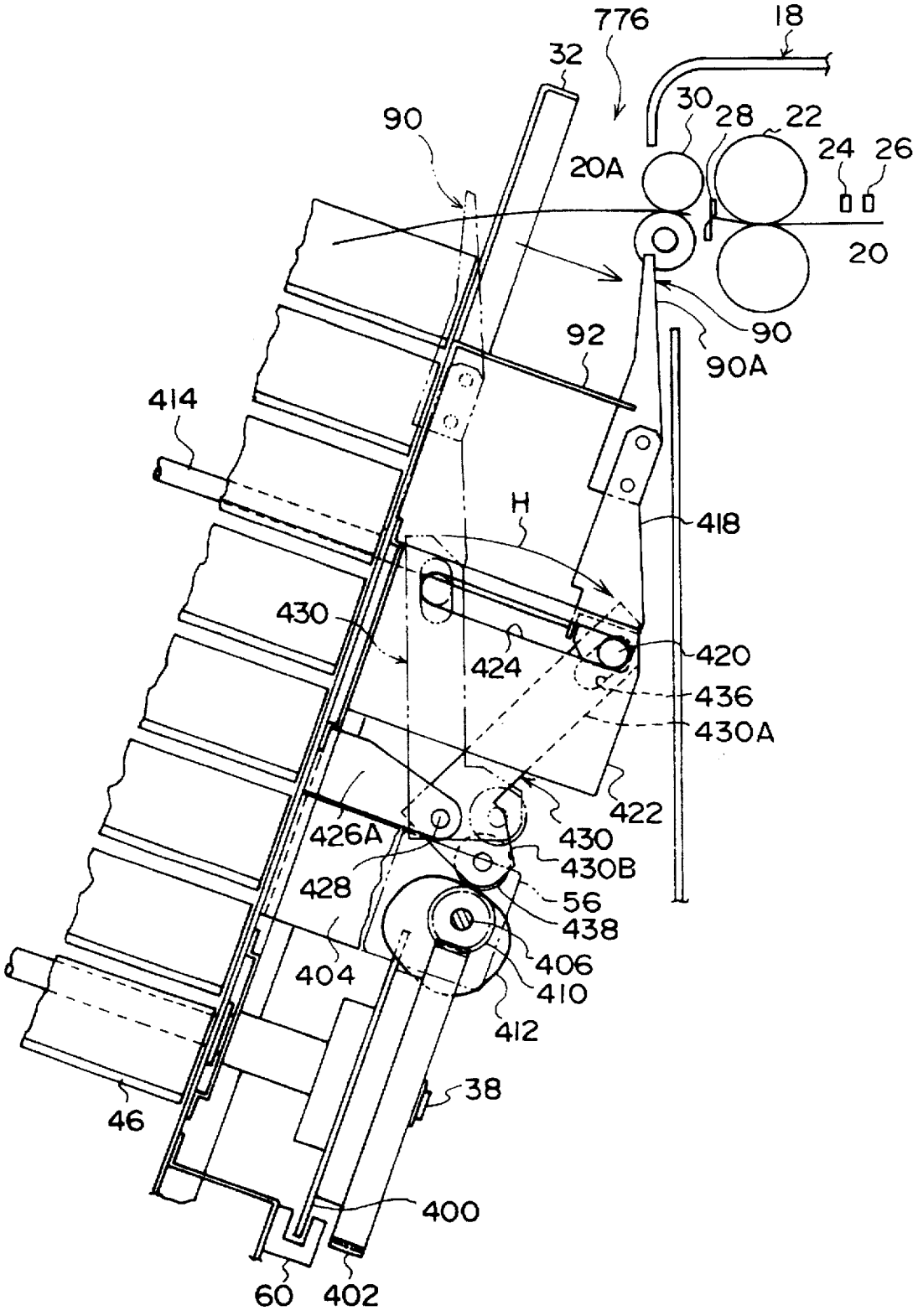
FIG. 18 is an enlarged view of a print pushing-out device and its vicinity of the sorting/conveying apparatus shown in FIG. 16.

As shown in FIG. 18, an elongated hole 424 extending in a direction perpendicular to the planar direction of the side plate 32 is formed in the frame 422, and one bearing 420 of the moving member 416 is inserted in the elongated hole 424.

As shown in FIGS. 16, 17, and 18, a bracket 426 having a substantially U-shaped cross section is attached to the outer surface of the side plate 32. A shaft 428 is inserted in side plates 426A and 426B of the bracket 426 which are disposed perpendicularly to the planar direction of the side plate 32.

As shown in FIG. 18, a swinging arm 430 formed of a metal plate and having a U-shaped cross section is comprised of a long arm portion 430A and a short arm portion 430B connected to one end of the long arm portion 430A, and is thereby formed substantially in an L-shape. A connecting portion between the long arm portion 430A and the short arm portion 430B of the swinging arm 430 is disposed between the side plates 426A and 426B. A pair of holes (not shown) are respectively formed in the pair of side portions of the swinging arm 430 where the long arm portion 430A and the short arm portion 430B are connected, and bearing bushes (not shown) are fitted in the respective holes. The aforementioned shaft 428 is inserted in the bearing bushes. Consequently, the swinging arm 430 is easily capable of swinging about the shaft 428.

As shown in FIG. 17, the shaft 428 is loaded with a torsion coil spring 434. The torsion coil spring 434 has one end retained by the side plate 426A of the bracket 426 and the other end retained by the swinging arm 430, so as to urge the swinging arm 430 clockwise (in the direction of arrow H) in FIG. 22, as shown in FIG. 18.

An elongated hole 436 is formed in an upper portion of the long arm portion 430A, and the other bearing 420 of the moving member 416 is inserted in the elongated hole 436.

As shown in FIGS. 17 and 18, the bearing 438 which rotates while coming into contact with the outer surface of the aforementioned cam 412 is attached to a distal end of the short arm portion 430B. Incidentally, the bearing 438 is constantly pressed against the outer surface of the cam 412 by a predetermined urging force of the torsion coil spring 434.

Figure 21:
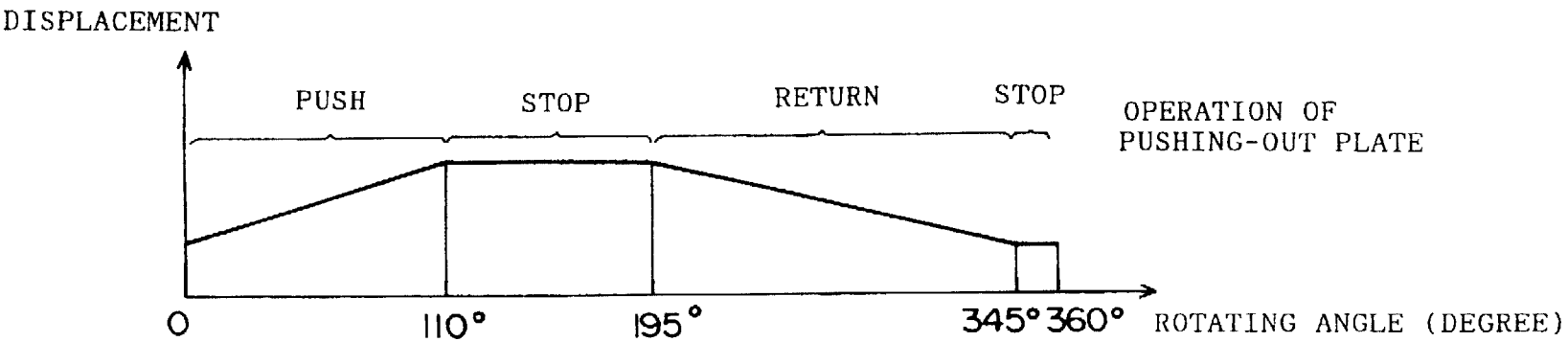
FIG. 21 is a graph illustrating the relationship between a rotating angle of a cam and the displacement of a bearing.

Incidentally, the relationship between the rotating angle of the cam 412 and the displacement of the bearing 420 is shown in FIG. 21.

As shown in FIG. 20, a pair of slits 94 are formed in the placing plate 92 and the side plate 32, respectively, and the print pushing-out plate 90 projects above the placing plate 92 through these slits 94.

As shown in FIG. 18, when the print pushing-out plate 90 is moved to one extreme end on the side plate 32 side (in the state shown by the phantom lines in FIG. 18), the print pushing-out plate 90 is adapted to enter the inner side of the side plate 32 (i.e., the receiving tray 46 side of the side plate 32) by a small amount. On the other hand, when the print pushing-out plate 90 is moved to the other extreme end on the cutter section 18 side (in the state shown by the solid lines in FIG. 18), the print pushing-out plate 90 is located substantially directly below the discharge rollers 30.

As shown in FIG. 20, escaping portions 47 for allowing the print pushing-out plate 90 to escape are formed in the receiving tray 46, whereby the print pushing-out plate 90 is capable of pushing the cut print 20A to a predetermined position on the receiving tray 46 in such a way that the cut print 20A will not be caught by the end portion of the receiving tray 46.

Figure 19:
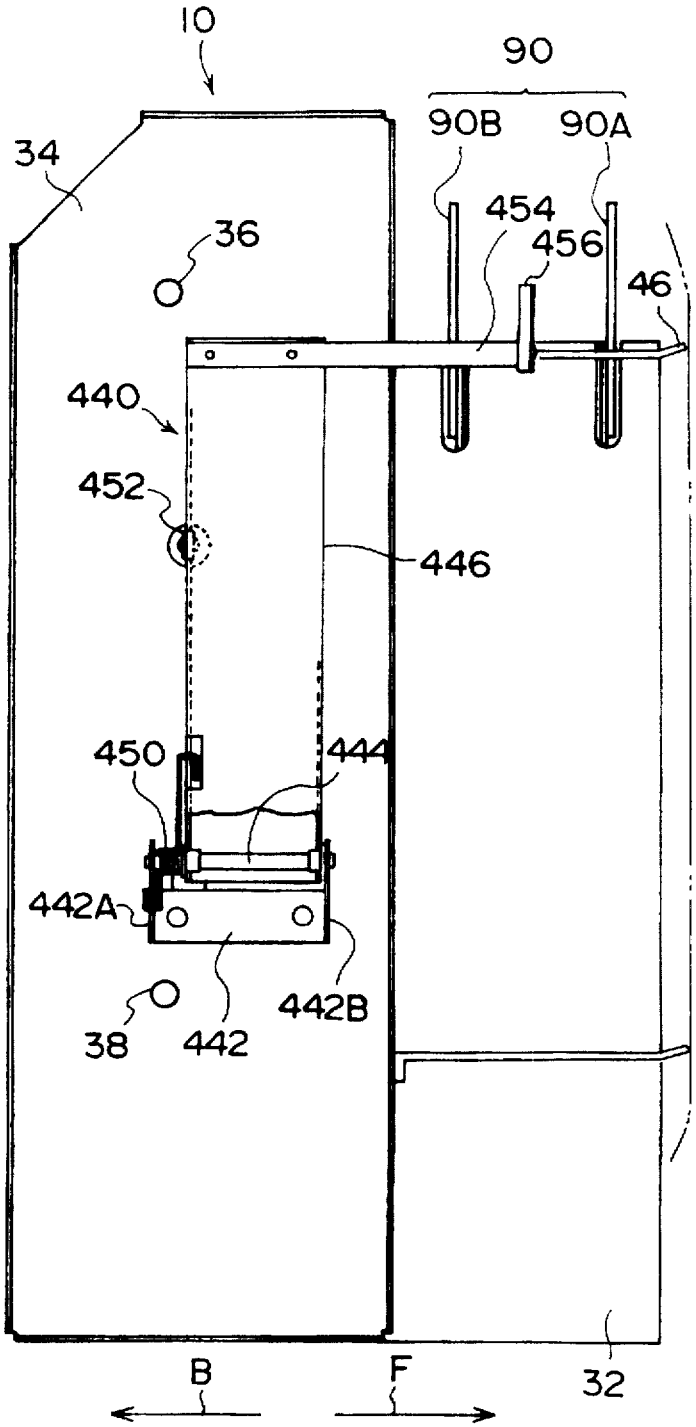
FIG. 19 is a view of the sorting/conveying apparatus taken in the direction of arrow D in FIG. 16.

As shown in FIGS. 16 and 19, a leading-end stopper 440 for stopping the cut prints 20A discharged from the cutter section 18 is provided on the side plate 34. The leading-end stopper 440 has a bracket 442 having a substantially U-shaped cross section and attached to the side plate 34. A shaft 444 is passed through side plates 442A and 442B of the bracket 442 which are disposed perpendicularly to the planar direction of the side plate 34.

A lower portion of a swinging arm 446, which is formed of a metal plate and having a substantially U-shaped cross section, is disposed between the side plates 442A and 442B. Holes (not shown) are formed in side portions of the lower portion of the swinging arm 446, and bearing bushes (not shown) are fitted in the respective holes. The shaft 444 is inserted in the bearing bushes, so that the swinging arm 446 is easily capable of swinging about the shaft 444.

The shaft 444 is loaded with a torsion coil spring 450. The torsion coil spring 450 has one end retained by the side plate 442A of the bracket 442 and the other end retained by the swinging arm 446, so as to urge the swinging arm 446 clockwise (in the direction of arrow I) in FIG. 16.

As shown in FIGS. 16 and 19, a small bearing 452 is attached to an end of the slide shaft 414 projecting from the side plate 34. This bearing 452 abuts against an edge portion of a longitudinally intermediate portion of the swinging arm 46.

A shaft 454 is attached horizontally to an upper end of the swinging arm 446. The shaft 454 extends toward the front (i.e., in the direction of arrow F), and a stopper plate 456 is attached to a distal end of the shaft 454.

As shown in FIGS. 16, 19, and 20, in this embodiment, in a case where the print pushing-out plate 90 is located on the cutter section 18 side (as in the state shown by the solid lines), the slide shaft 414 projects from the side plate 34 by a small amount, and the planar direction of the swinging arm 446 urged by the torsion coil spring 450 is substantially parallel to the planar direction of the side plate 34. As shown in FIG. 20, the stopper plate 456 at this time is advanced by a predetermined amount into a groove 458 formed in the receiving tray 46, so that the dimension W between an end 456A of the stopper plate 456 on the one hand, and the ends of the side plates 90A and 90B which face the receiving tray 46 on the other, in this embodiment, is set to a dimension which is provided with slight leeway with respect to the maximum length of the cut print 20A of a panoramic size. Thus, the arrangement provided is such that the cut print 20A of the panoramic size can be accommodated between the print pushing-out plate 90 and the stopper plate 456.

In addition, as shown in FIG. 16, since the cut prints 20A are conveyed by the tray-supporting members 44 and the receiving trays 46, if it is assumed that the distance between the side plate 34 and the print pushing-out plate 90 located on the receiving tray 46 side is $W_1$, that the amount of movement of the print pushing-out plate 90 is $L_1$, that the dimension from the inner side of the side plate 34 to the end 456A of the stopper plate 456 advanced into the groove 458 in the receiving tray 46 is $L_2$, and that the amount of movement of the stopper plate 456 is $L_3$, then the relationship of $W_1=(W-L_1)+L_2$ holds. Thus, the relation $W_1>W$ is satisfied so that the leading ends of the cut prints 20A will not abut against the side plate 34 when the cut prints 20A are pushed toward the receiving tray 46. Incidentally, a setting is provided such that $L_2>L_1$ in order to satisfy $W_1>W$, and the relation with $L_3$ is set to be such that $L_3>L_2>L_1$.

Incidentally, slits (not shown) for detection by the optical sensor 60 are formed circumferentially at predetermined intervals on the slit disk 400 which rotates simultaneously with the worm wheel 402, so that the cam 412 can be stopped each time the cam 412 undergoes one revolution.

Next, referring to the flowchart shown in FIG. 22, a description will be given of the operation of the sorting/conveying apparatus 10 in accordance with this embodiment.

In this embodiment as well, in the same way as in the first embodiment, a one-order portion of cut prints 20A is stacked on the receiving tray 46 through Steps 200 to 216, and points which differ from the first embodiment will be described hereafter in detail.

In the sorting/conveying apparatus 10, the cut prints 20*a* discharged from the cutter section 18 are accumulated on the placing plate 92 and the receiving tray 46. However, it is considered that there are cases where the cut prints 20A of the elongated panoramic size are discharged from the cutter section 18.

Figure 23:
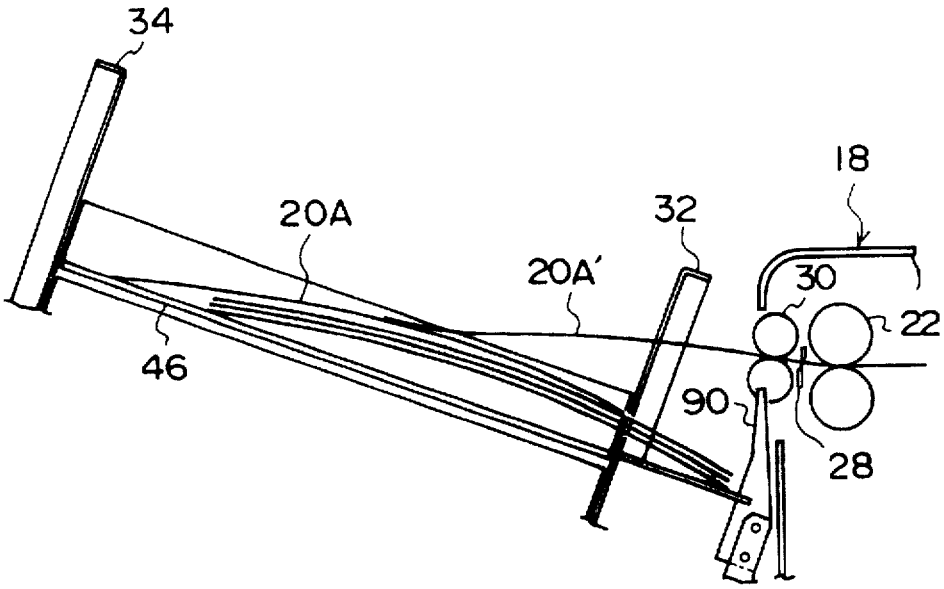
FIG. 23 is front elevational view of the sorting/conveying apparatus which is not provided with a stopper plate.
Figure 24:
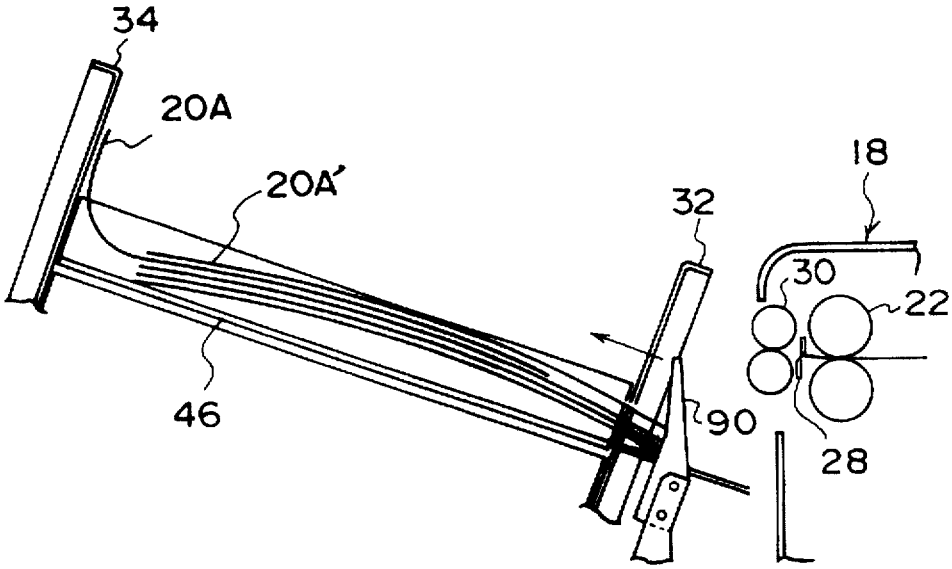
FIG. 24 is a front elevational view of the sorting/conveying apparatus which is not provided with the stopper plate, and illustrates a state in which the cut print is forcibly warped.
Figure 25:
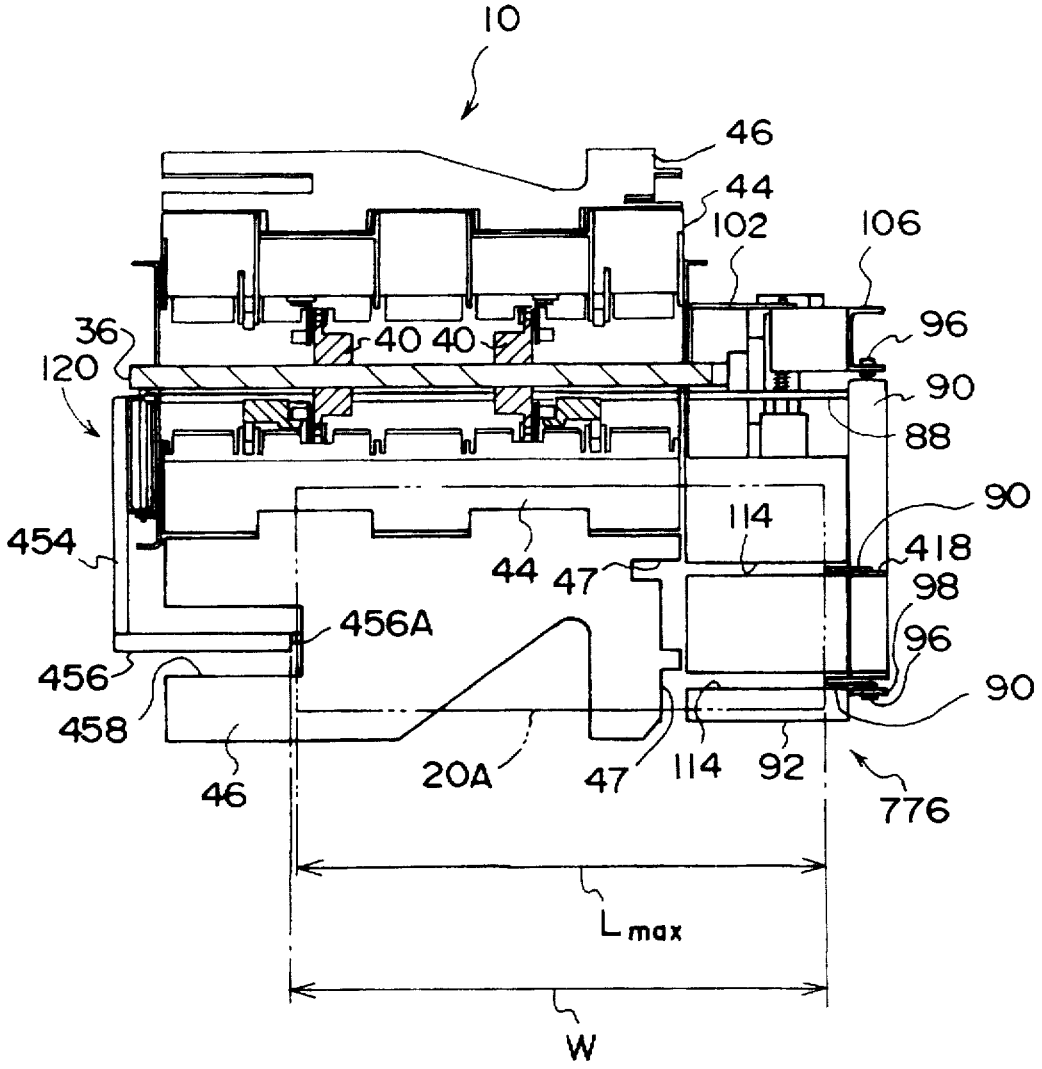
FIG. 25 is a partly cross-sectional view of the sorting/conveying apparatus in accordance with a modification of the fourth embodiment of the present invention, and corresponds to FIG. 20.

In such a case, in a case where an ensuing cut print 20A of the panoramic size is discharged from the cutter section 18 onto the top of the already accumulated cut print 20A of the panoramic size, if the stopper plate 456 is not provided as shown in FIG. 23, it is conceivable that the leading end of an ensuing cut print 20A' being discharged comes into contact with the upper surface (photosensitive surface) of the already accumulated cut print 20A, and the uppermost cut print 20A already accumulated is offset toward the side plate 34. In such a state, if the accumulated cut prints 20A and 20A' are pushed by the print pushing-out plate 90, there are cases where the leading end of the cut print 20A offset toward the side plate 34 is brought into contact with the side plate 34 and is forcibly warped, as shown in FIG. 24. If the receiving tray 46 is moved in the state in which the cut print 20A is brought into contact with the side plate 34, there is the risk of the end of the cut print 20A becoming damaged by being brought into frictional contact with the side plate 34.

In this embodiment, however, when the cut prints 20A are stacked on the placing plate 92 and the receiving tray 46, the stopper plate 456 is in a state in which it is already advanced in the groove 458 of the receiving tray 46. Therefore, even if the leading end of the ensuing cut print 20A' is brought into contact with the uppermost one of the already accumulated cut prints 20A, since the already accumulated cut prints 20A are prevented from becoming offset by coming into contact with the stopper plate 456, the cut prints 20A are prevented from abutting against the side plate 34 during accumulation, thereby allowing the cut prints 20A to be accumulated in an orderly manner.

Incidentally, when the cut prints 20*a* are accumulated, the bearing 438 of the swinging arm 430 is located at a position where the distance from the center of rotation to the outer peripheral surface of the cam 412 is the shortest.

Figure 22:
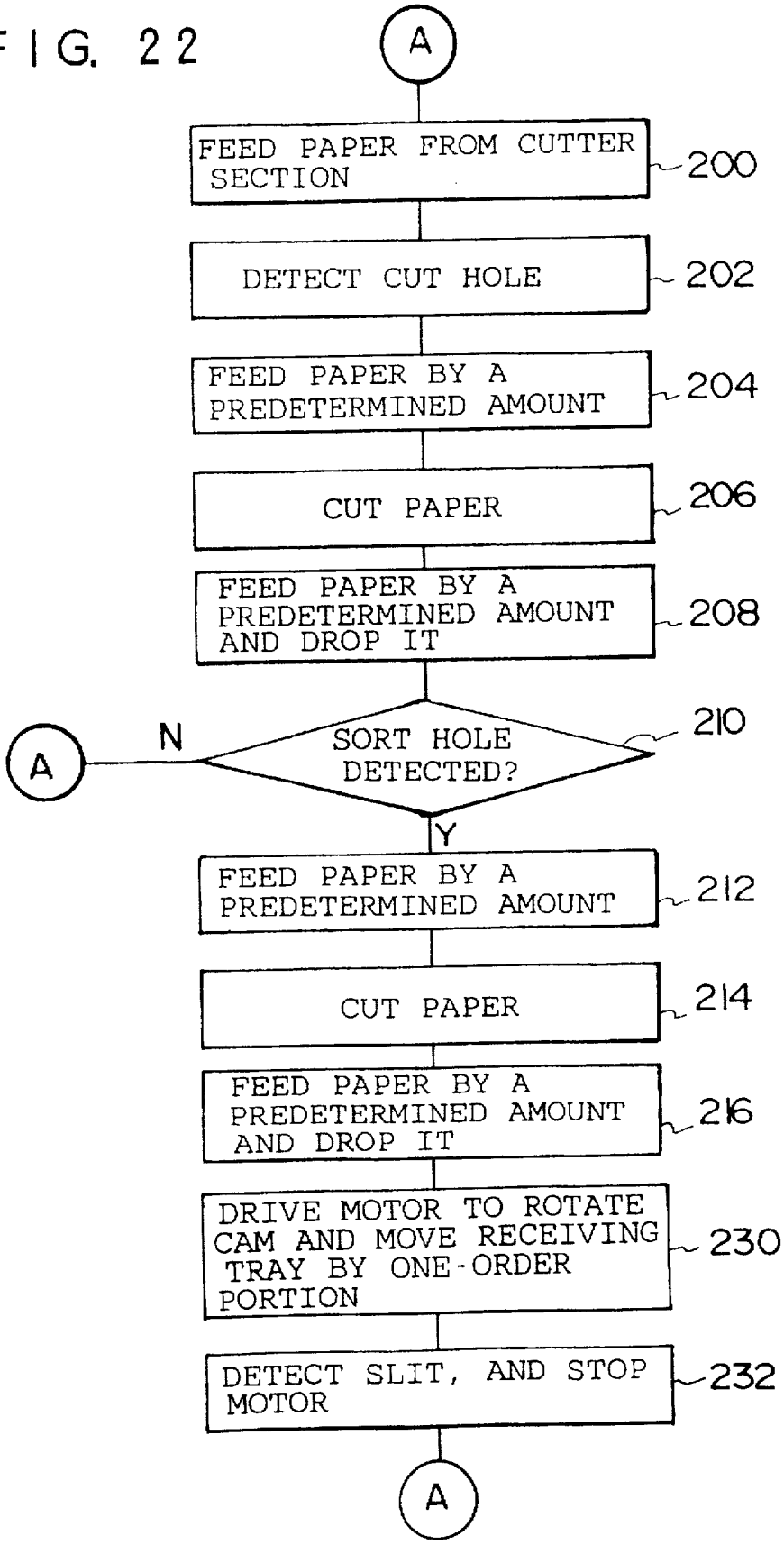
FIG. 22 is a flowchart explaining the operation of the fourth embodiment.

As shown in FIG. 22, in the control in accordance with this embodiment, when the final cut print 20A of the order is discharged and dropped in Step 216, the operation proceeds to Step 230. In Step 230, the geared motor 56 is driven to rotate the cam 412 and the worm wheel 402.

As the worm wheel 402 rotates, the receiving tray 46 with the cut prints 20*a* accumulated thereon moves downward.

In addition, while the cam 412 rotates 110° from the starting point of rotation, the bearing 438 of the swinging arm 430 is lifted upward by being pressed by the outer peripheral surface of the cam 412, so that the swinging arm 430 rotates counterclockwise in FIG. 22 (in a direction opposite to the direction of arrow H). As the swinging arm 430 rotates, the moving member 416 approaches the side plate 32 side, so that the print pushing-out plate 90 pushes the one-order portion of the accumulated cut prints 20A toward the receiving tray 46. Concurrently, the slide shaft 414 slides in the direction in which the cut prints 20A are pushed, while the swinging arm 446 is pushed by the bearing 452 attached to the distal end of the slide shaft 414 and rotates counterclockwise in FIG. 16 (in a direction opposite to the direction of arrow I), thereby allowing the stopper plate 456 to retreat from the groove 458 in the receiving tray 46. At the point of time when the pushing operation by the print pushing-out plate 90 is completed (when the cam 412 has rotated 110°), the side plate 34-side ends of the cut prints 20*a* are located at a position spaced apart from the side plate 34 by a predetermined dimension. Accordingly, the ends of the cut prints 20*a* are prevented from coming into contact with the side plate 34 during the movement of the receiving tray 46.

Next, while the cam 412 rotates from 110° to approximately 195°, the bearing 438 of the swinging arm 430 is not displaced by the cam 412 (since the distance from the center of rotation to the outer surface of the cam is fixed between 110° to approximately 195°), so that the print pushing-out plate 90 is stopped in the state in which it has entered the inner side of the side plate 32 by a small amount.

Then, while the cam 412 rotates from approximately 195° to 345°, since the distance from the center of rotation to the outer surface of the cam is slightly reduced, the swinging arm 430 rotates clockwise (in the direction of arrow H), so that the print pushing-out plate 90 approaches the cutter section 18 side most. In this embodiment, the arrangement provided is such that the print pushing-out plate 90 starts to return toward the cutter section 18 side when the uppermost one of the accumulated cut prints 20A is lower than the placing plate 92.

Subsequently, while the cam 412 rotates from 345° to 360° (completes one revolution), the bearing 438 of the swinging arm 430 is not displaced by the cam 412 (since the distance from the center of rotation to the outer surface of the cam is fixed), so that the print pushing-out plate 90 is stopped in the state in which it is located at the other extreme end on the cutter section 18 side.

In Step 232, the slit in the slit disk 400 is detected by the optical sensor 60, and the geared motor 56 is stopped. Incidentally, the rotation of the geared motor 56 is stopped when the cam 412 has rotated 360°, i.e., has undergone one revolution. At this time, an ensuing empty receiving tray 46 is stopped at a predetermined position on the side of the placing plate 92. Then, when an ensuing slit is detected by the optical sensor 60 (in other words, this represents the completion of the movement of the receiving tray 46 by a one-order portion), the operation returns to Step 200 in which the cutting of the printing paper 20 for an ensuing order is started by the cutter section 18.

Subsequently, insofar as there is an oncoming portion of the printing paper 20 subjected to dry processing, the above-described processing is repeated, and each receiving tray 46 with each one-order portion of cut prints 20A accumulated thereon is consecutively conveyed downward.

Figure 26:
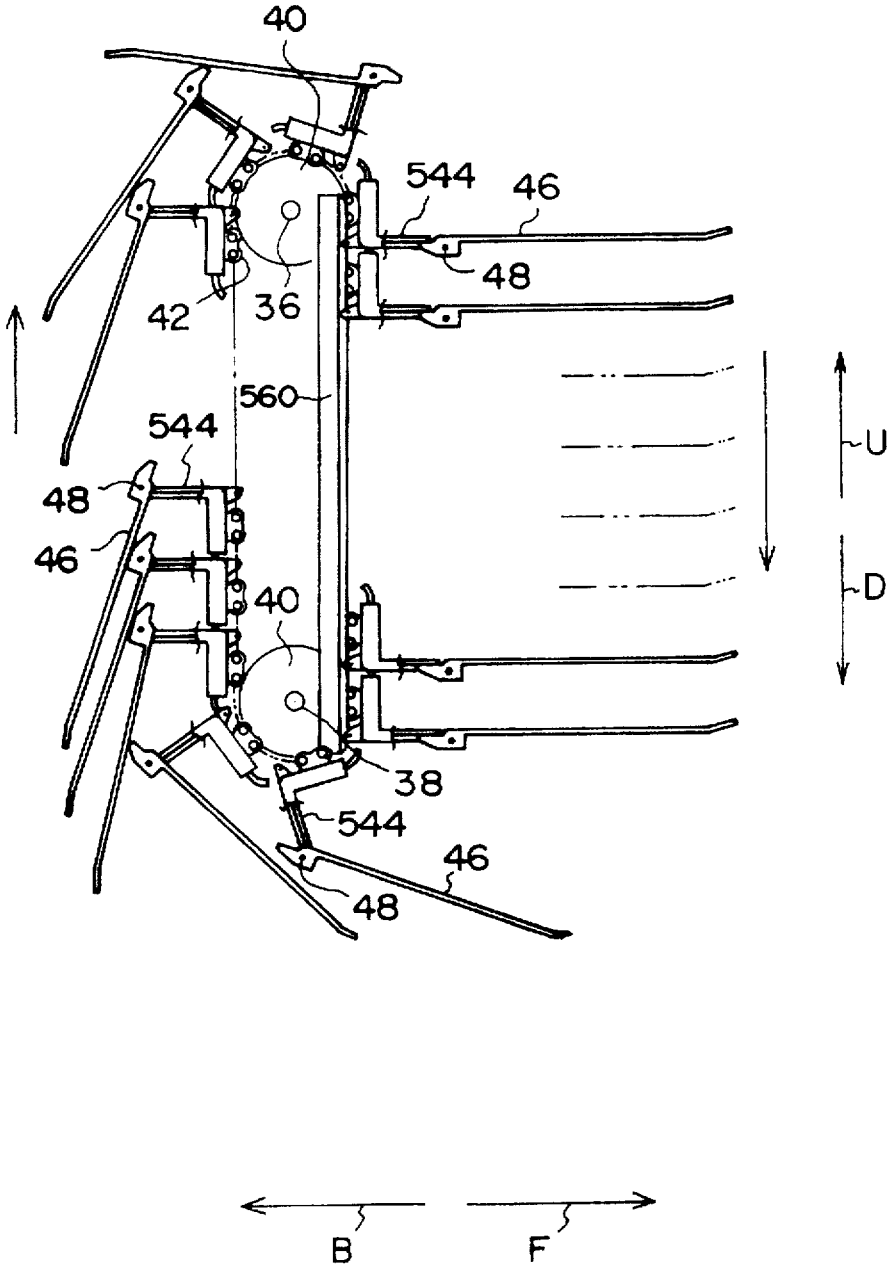
FIG. 26 is a cross-sectional view, taken from the side of tray-supporting members and trays, of an endless chain and its vicinity of the sorting/conveying apparatus in accordance with a modification of the fourth embodiment of the present invention.
Figure 27:
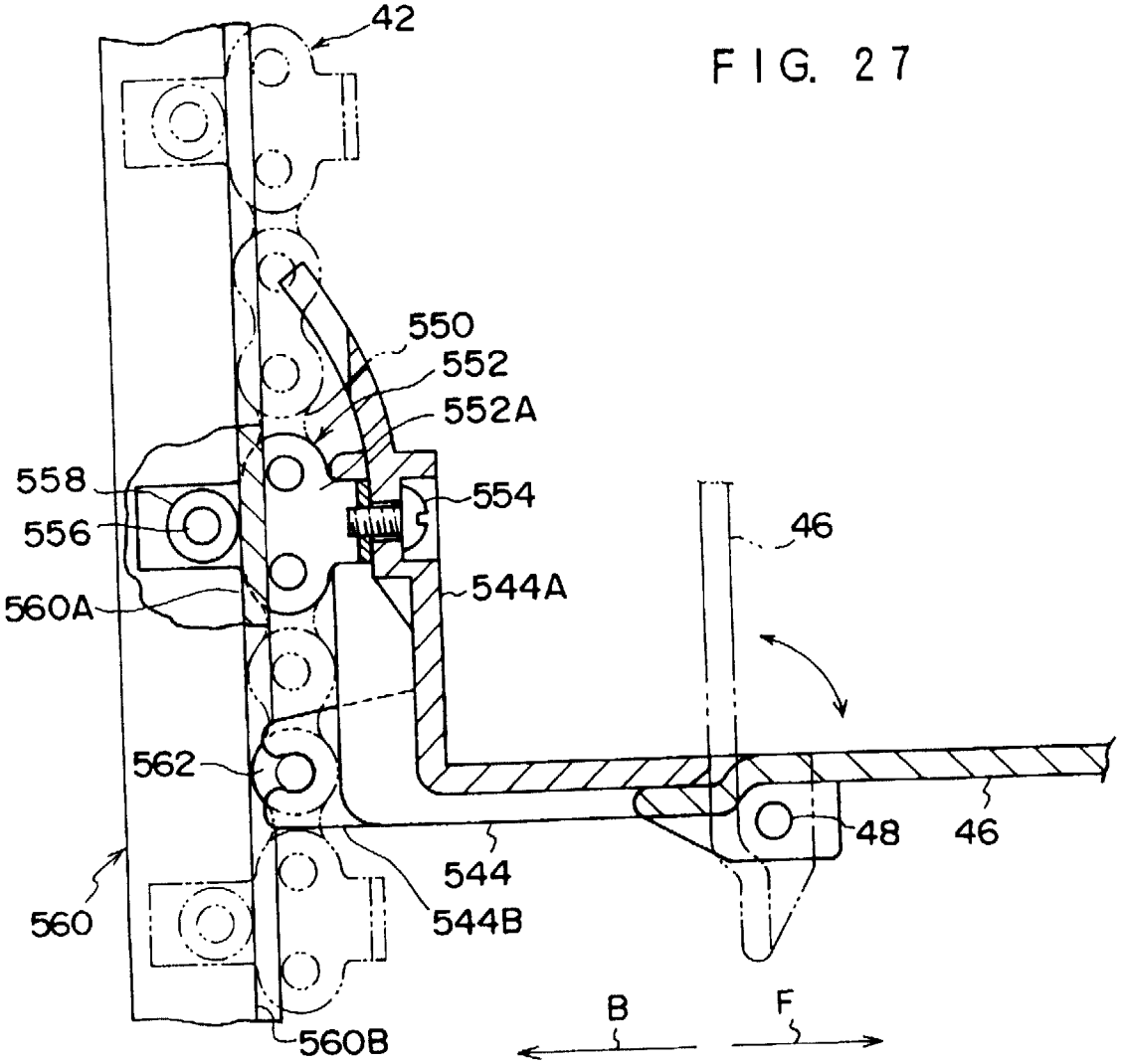
FIG. 27 is a view, taken from the tray-supporting member, of a portion for attaching the tray-supporting member to the endless chain.

As shown in FIGS. 26 and 27, when the tray-supporting members 544 and the receiving trays 46 are conveyed downward, and outer links 552 of the endless chains 42 supporting them engage the sprockets 40, the tray-supporting members 544 cease to be guided by guide rails 560, so that the outer links 552 move while engaging the sprockets 40. Consequently, the tray-supporting members 544 and the receiving trays 46 are inclined, so that the one-order portion of the cut prints 20A are slid over the upper front side of the processor section 16.

The pushing-out time and the returning time of the print pushing-out plate 90 can be easily and freely controlled by the use of the cain 412 as in this embodiment.

It should be noted that the pushing-out time for pushing the cut prints 20A by the print pushing-out plate 90 is preferably set to a short time since the receiving trays 46 have already started to move.

In addition, the time when the print pushing-out plate 90 is stopped after pushing out the cut prints 20A should be preferably long so as to ensure the stability of the accumulated cut prints 20A. The reason for this is that unless the print pushing-out plate 90 is returned toward the cutter section 18 side when the uppermost one of the accumulated cut prints 20A has become lower than the placing plate 92, there are cases where the upper side of the cut prints 20A is offset toward the placing plate 92 simultaneously as the print pushing-out plate 90 returns.

In addition, the return time of the print pushing-out plate 90 should be preferably short in preparation for receiving the cut prints 20A of the next order.

Incidentally, in this embodiment as well, since the worm wheel 402 is meshed with the worm gear 410 in the same way as in the second embodiment, even if the cut prints 20A have been accumulated on the receiving trays 46 and the load is thereby offset, the receiving trays 46 are prevented from moving unexpectedly.

Figure 14:
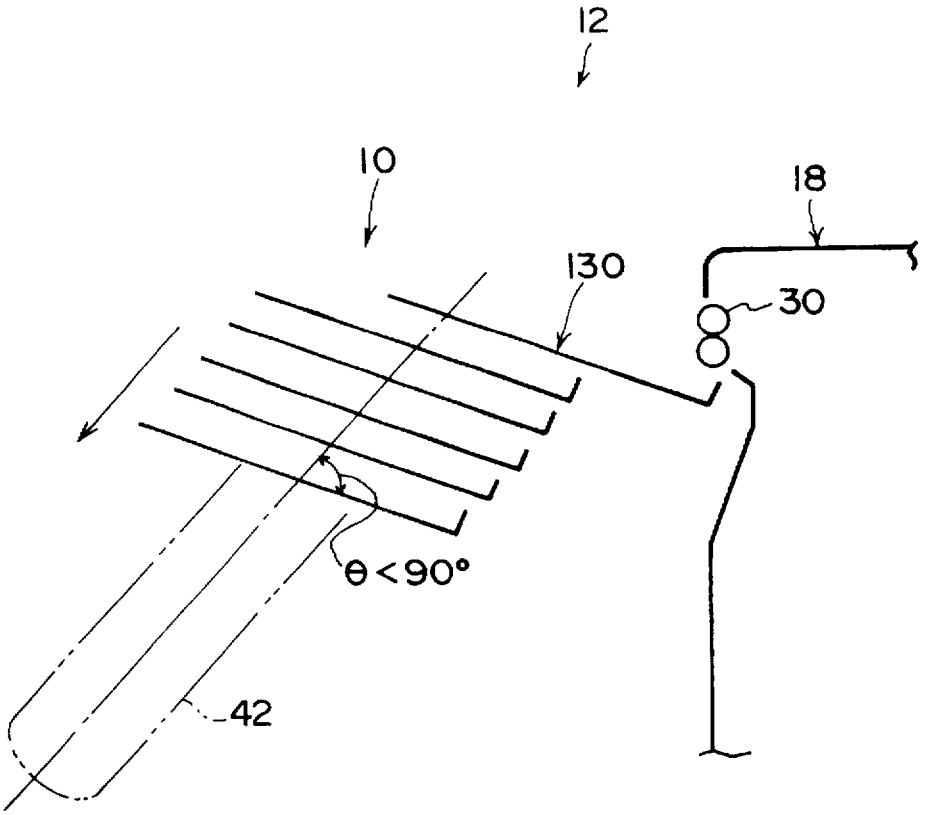
FIG. 14 is a front view of the sorting/conveying apparatus in accordance with an example of the present invention.

Incidentally, although, in the foregoing embodiments, the linear portions of the chains 42 are arranged orthogonally to the receiving trays 46 and 130, the linear portions of the chains 42 may not be arranged orthogonally to the receiving trays 46 and 130, as shown in FIG. 14.

Next, a modification of the fourth embodiment will be shown in FIGS. 25 to 28. Incidentally, the same component parts and arrangements as those of the foregoing embodiments will be denoted by the same reference numerals, and a description thereof will be omitted.

As shown in FIG. 27, the endless chain 42 has the structure of a general roller chain in which inner links 550 and the outer links 552 are alternately connected to each other. However, as shown in FIGS. 27 and 28, predetermined outer links 552 are each provided with an L-shaped outer plate 552A.

One end of the outer plate 552A which is shaped in an L-shape is connected by a screw 554 to an intermediate portion, which is parallel to the longitudinal direction of the endless chain 42, of a side plate 544A of the tray-supporting member 544 on the endless chain 42 side.

A pin 556, which is provided substantially parallel to the shafts 36 and 38, is secured to a vicinity of an end of the outer plate 552A which is away from the end where the tray-supporting member 544 is connected. A roller 558 is rotatably attached to each pin 556.

Figure 28:
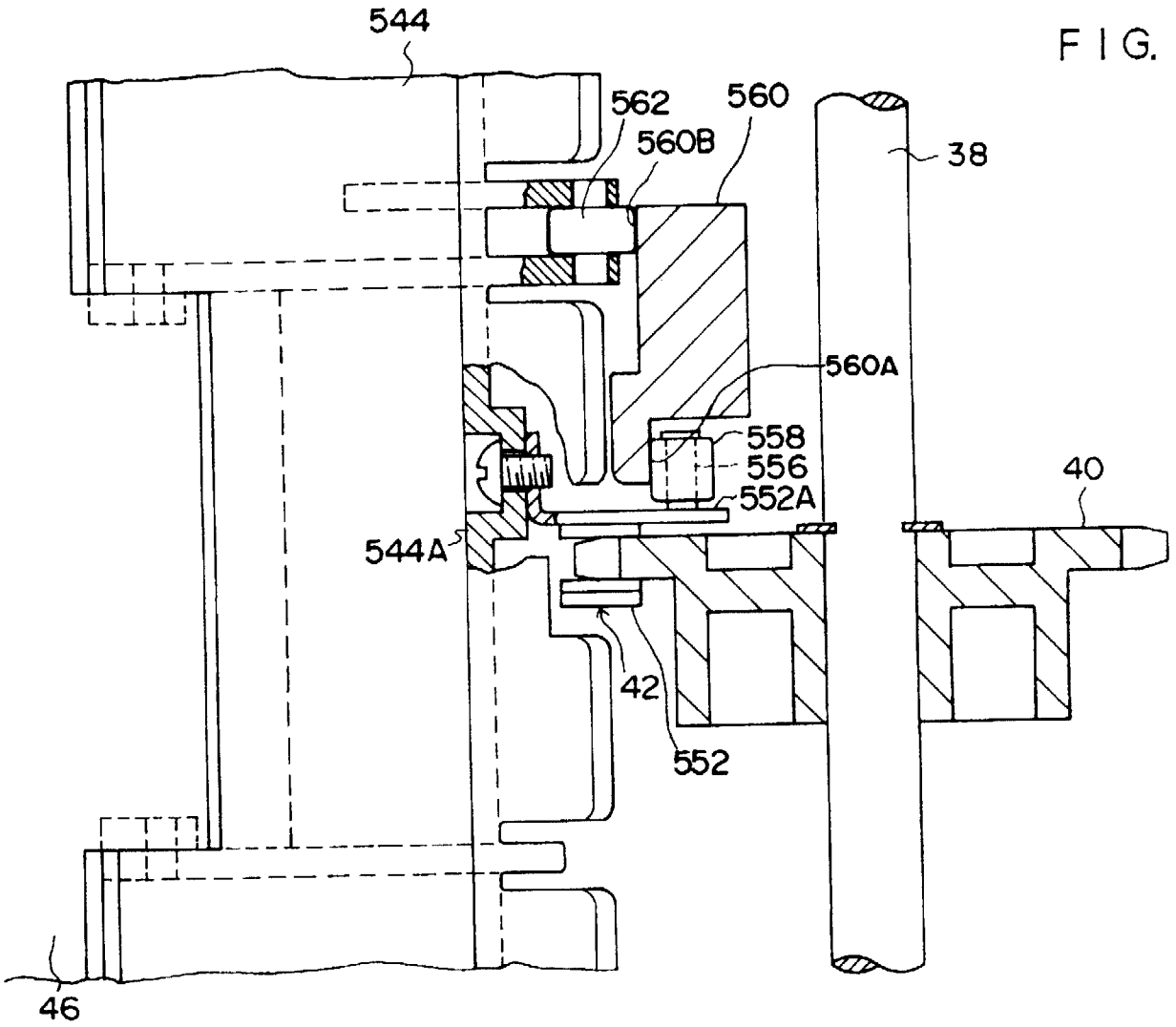
FIG. 28 is a view, taken from the longitudinal direction of a guide rail, of the portion for attaching the tray-supporting member to the endless chain.
Figure 29:
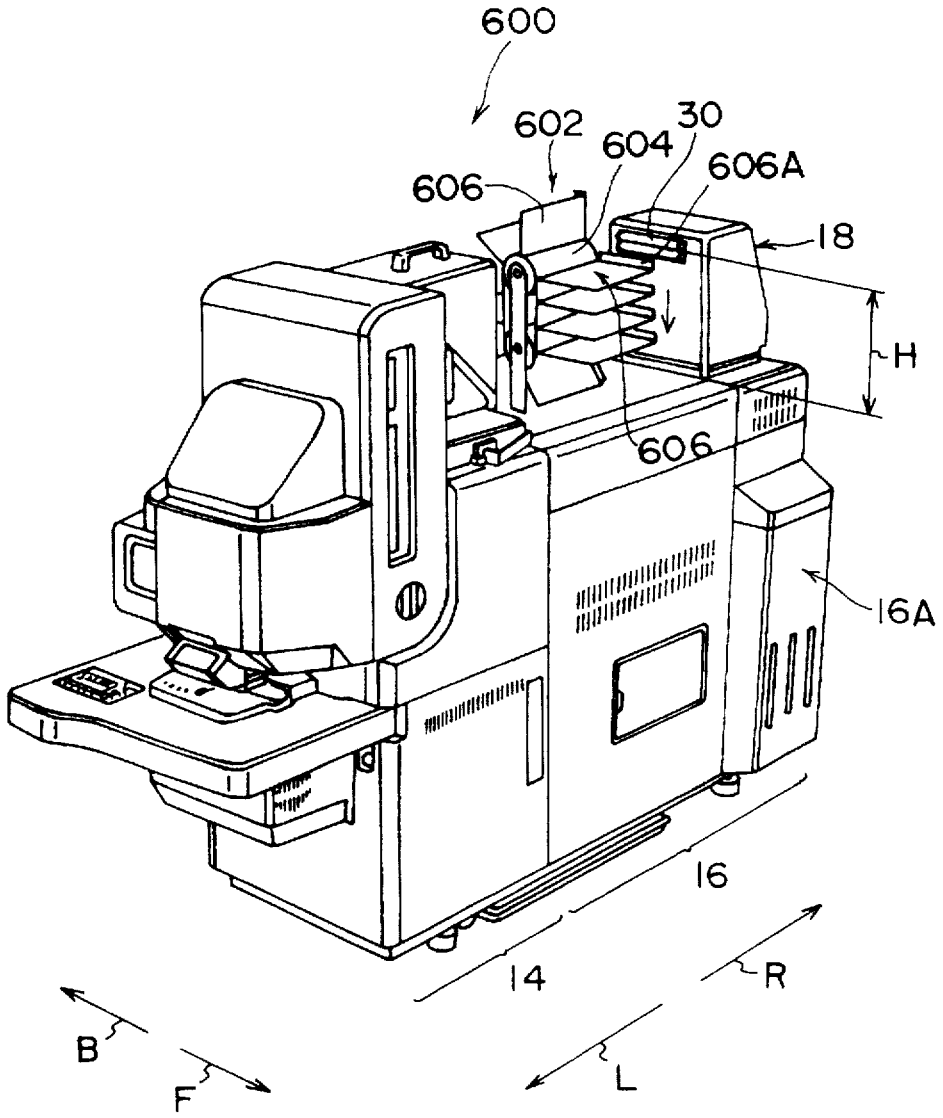
FIG. 29 PRIOR ART
FIG. 29 is a perspective view of a print processor to which a conventional sorting/conveying apparatus is applied.
Figure 30:
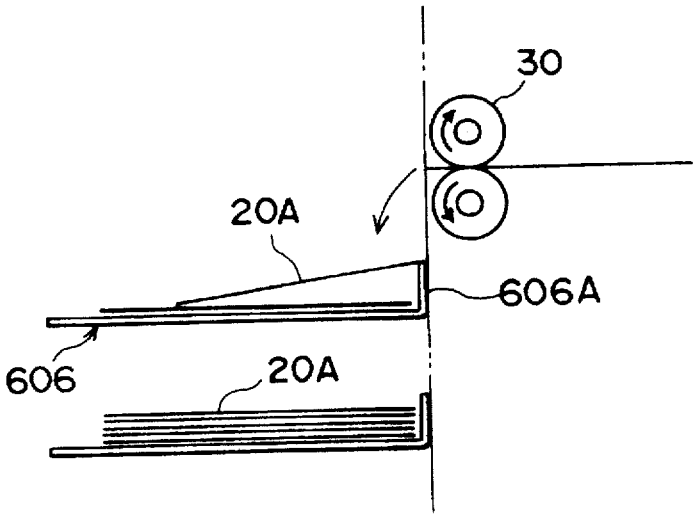
FIG. 30 PRIOR ART
FIG. 30 is a side elevational view of discharge rollers and receiving trays, and illustrates the manner in which prints are received in the conventional sorting/conveying apparatus.
Figure 31:
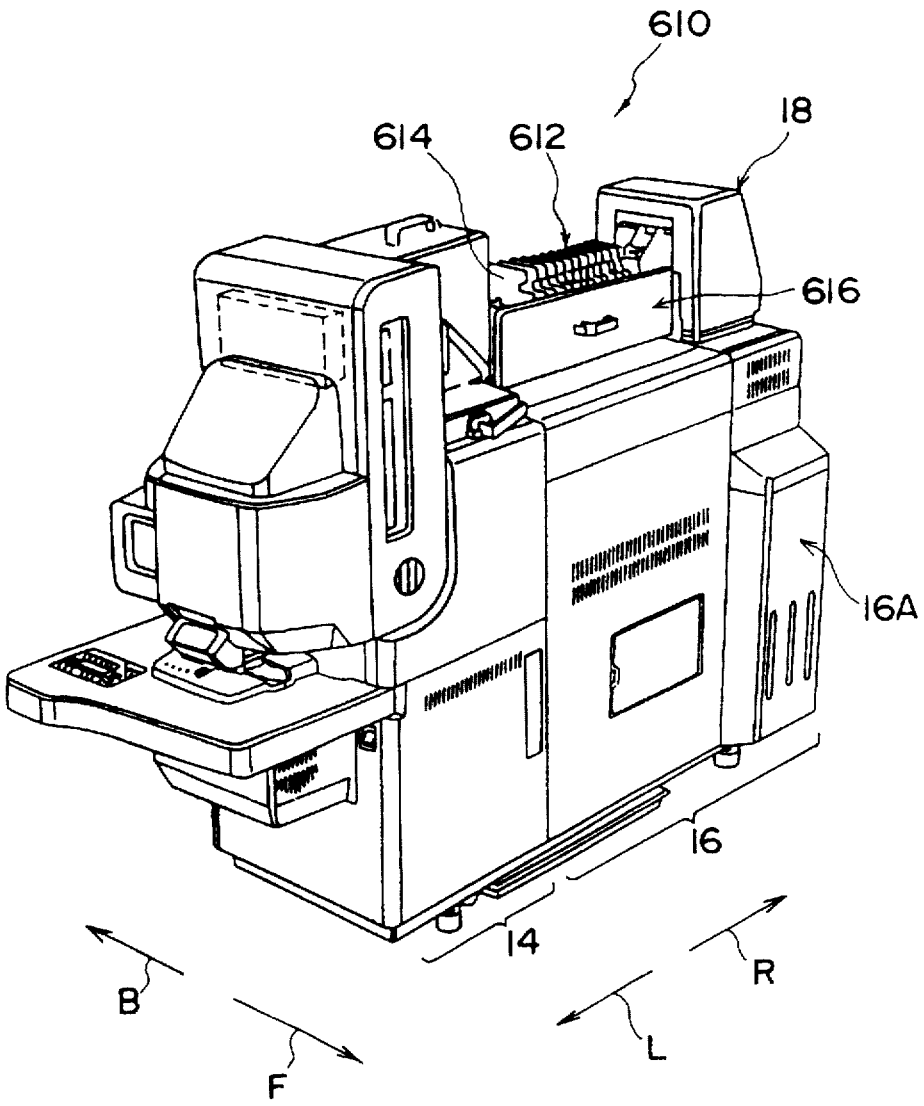
FIG. 31 PRIOR ART
FIG. 31 is a perspective view of a print processor to which a conventional sorting/conveying apparatus of another type is applied.
Figure 32:
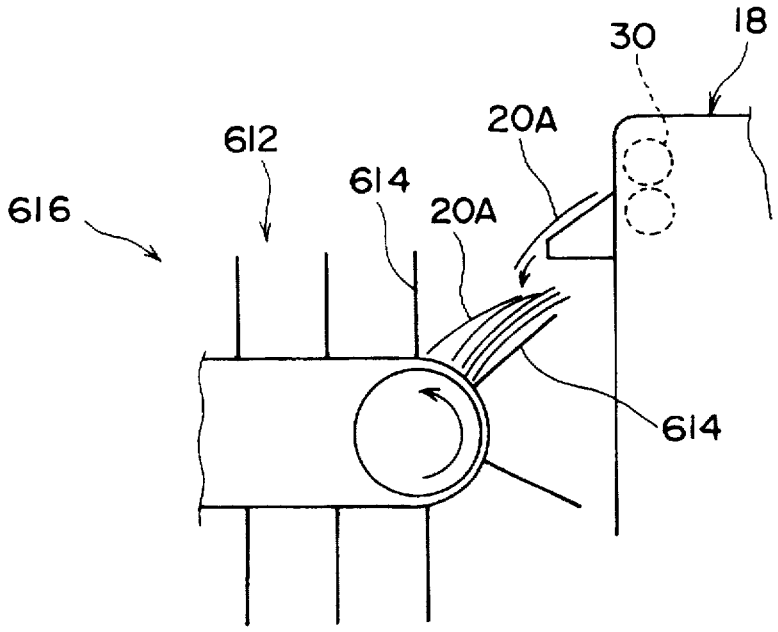
FIG. 32 PRIOR ART
FIG. 32 is a side elevational view of a conveyor, and illustrates the manner in which prints are received in the sorting/conveying apparatus shown in FIG. 31.

As shown in FIGS. 26 and 28, the guide rail 560 serving as a guide member is provided on the side of each endless chain 42 along the linear portion of thereof (i.e., a conveying passage portion for conveying the photosensitive material). These guide rails 560 are secured to the side plates 32 and 34 by means of unillustrated fittings.

As shown in FIGS. 27 and 28, the rollers 558 of the endless chain 42 are adapted to rotate in contact with a traveling surface 560A provided on each guide rail 560.

As shown in FIGS. 27 and 28, a roller 562, which rotates in contact with a traveling surface 560B provided on the axially opposite side of the shaft 38 with respect to the traveling surface 560A, is attached to a corner portion 544B of the tray-supporting member 544. Incidentally, this roller 562 is located below the portion where the outer plate 552 and the side plate 544A are screwed when the tray-supporting member 544 is located on the front side of the print processor 12.

In this embodiment, the rollers 558 and the rollers 562 correspond to inclination-preventing members in accordance with the present invention.

When the tray-supporting member 544 is located on the front side of the print processor 12, the roller 558 is pressed against the traveling surface 560A by the weight of the tray-supporting member 544 and the receiving tray 46, and the roller 562 is pressed against the traveling surface 560B. The arrangement provided is such that, at this time, the receiving tray 46 becomes orthogonal to the linear portion of the endless chain 42.

When the tray receiving member 544 and the receiving tray 46 are located on the front side of the print processor 12 so as to receive the cut prints 20A, the roller 558 is pressed against the traveling surface 560A by the weight of the tray receiving member 544, the receiving tray 46, and the cut prints 20A, and the roller 562 is pressed against the traveling surface 560B. Hence, the receiving tray 46 is maintained orthogonally to the linear portion of the endless chain 42, and is not inclined.

Incidentally, although, in this embodiment, the inclination of the tray receiving member 544 and the receiving tray 46 is prevented as the guide rail 560 is nipped by the roller 558 and the roller 562, the present invention is not restricted to the same. For instance, the roller 558 and the roller 562 may be substituted by sliding members having a low coefficient of friction, such as Teflon (trademark) and nylon.

Although the above-described modification has been described in correspondence with the fourth embodiment, the present invention is not restricted to the same, and the modification may be made to correspond to the first to third embodiments as well.

In addition, in the present invention, an endless belt may be used instead of the chain 42.

As described above, the photosensitive-material conveying apparatus in accordance with the first aspect of the present invention offers an outstanding advantage in that, by virtue of the above-described arrangements, the cut sheets of a photosensitive material can be conveyed in a state in which one ends thereof are arranged and the sheets of the photosensitive material are placed in a predetermined position on the photosensitive-material receiving member. In addition, there is an another outstanding advantage in that since the conveying direction of the endlessly conveying section is inclined with respect to the vertical direction, in a case where conveyance is effected over the same heightwise dimension, the conveying distance can be made longer, making it possible to provide a larger number of photosensitive-material receiving members and to prepare for a larger number of orders. Furthermore, since the conveying direction of the endlessly conveying section is inclined, and the cut sheets of the photosensitive material can be conveyed in such a manner as to move away from the drying section of the main body, it is possible to keep the stacked sheets of the photosensitive material away from the heat from the drying section.

In addition, the photosensitive-material conveying apparatus in accordance with the second aspect of the present invention offers an outstanding advantage in that, by virtue of the above-described arrangements, even if the dropped position of the cut sheets of the photosensitive material slightly varies, the cut sheets of the photosensitive material are not caught by the end of the photosensitive-material receiving member, and are accumulated and conveyed in parallel form inside the photosensitive-material receiving member. In addition, there is an another outstanding advantage in that since the conveying direction of the endlessly conveying section is inclined with respect to the vertical direction, in a case where conveyance is effected over the same heightwise dimension, the conveying distance can be made longer, making it possible to provide a larger number of photosensitive-material receiving members and to prepare for a larger number of orders. Furthermore, since the conveying direction of the endlessly conveying section is inclined, and the cut sheets of the photosensitive material can be conveyed in such a manner as to move away from the drying section of the main body, it is possible to keep the stacked sheets of the photosensitive material away from the heat from the drying section.

The photosensitive-material conveying apparatus in accordance with the third aspect of the present invention offers an outstanding advantage in that, since the inclination preventing member for preventing the inclination of the stacking member is guided by the guide member, the stacking member can be moved while maintaining a predetermined attitude irrespectively of the amount of the photosensitive material stacked, thereby allowing the photosensitive material to be conveyed in a stable state. In particular, in a case where the sheets of the photosensitive material are stacked and conveyed with their ends arranged, the stacked sheets of the photosensitive material are prevented from becoming collapsing.

The photosensitive-material conveying apparatus in accordance with the fourth aspect of the present invention offers an outstanding advantage in that the stopper makes it possible to prevent the sheets of the photosensitive material from being offset from a predetermined position in the discharging direction, thereby making it possible to convey the stacked sheets of the photosensitive material in an optimum state.

In addition, the photosensitive-material conveying apparatus in accordance with the fifth aspect of the present invention offers an outstanding advantage in that, since the stopper is made to retreat when the sheets of the photosensitive material are pushed out by the pushing-out member, it is possible to make effective use of the interior of the photosensitive-material receiving member.

What is claimed is:

1. A photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, said photosensitive-material conveying apparatus being adapted to stack the cut photosensitive material in a predetermined unit, said photosensitive-material conveying apparatus comprising:

an endlessly conveying section disposed above said main body and on a photosensitive-material discharging side of said cutter section, an upper portion of said endlessly conveying section being disposed in a vicinity of said discharging section, a lower portion of said endlessly conveying section being disposed at a position remote from said discharging section, such that a conveying direction is inclined with respect to a vertical direction;

a placing member disposed below said discharging section so as to place thereon the cut photosensitive material discharged from said discharging section;

a photosensitive-material receiving member provided in said endlessly conveying section to place the cut photosensitive material thereon; and a pushing-out member adapted to come into contact with one end of the cut photosensitive material placed on said placing member to push out the cut photosensitive material to a predetermined position on said photosensitive-material receiving member.

2. A photosensitive-material conveying apparatus according to claim 1, wherein said endlessly conveying section has an endless elongated member.

3. A photosensitive-material conveying apparatus according to claim 2, wherein said endlessly conveying section has a supporting member which is connected to said photosensitive-material receiving member and supports said photosensitive-material receiving member in a predetermined position.

4. A photosensitive-material conveying apparatus according to claim 3, wherein said supporting member rotatably supports said photosensitive-material receiving member.

5. A photosensitive-material conveying apparatus according to claim 2, wherein said endlessly conveying section has a pair of sprockets and a driving member, and said driving member drives said endless elongated member.

6. A photosensitive-material conveying apparatus according to claim 5, wherein said driving member imparts a driving force to said pushing-out member.

7. A photosensitive-material conveying apparatus according to claim 1, wherein said photosensitive-material receiving member has a projecting portion in a vicinity of said supporting member provided in said endlessly conveying section, and the rotation of said photosensitive-material receiving member is prevented when said projecting portion abuts against said supporting member.

8. A photosensitive-material conveying apparatus according to claim 1, wherein said pushing-out member has a pushing-out plate, a link member connected to said pushing-out plate, and a pushing-out-member driving member connected to said link member, and said link member transmits a driving force of said pushing-out-member driving member as a force for pushing out a print.

9. A photosensitive-material conveying apparatus according to claim 8, wherein said pushing-out member has a disk secured coaxially to a driving shaft of said pushing-out-member driving member, said disk being provided with a pin at a position spaced apart a predetermined distance from a center thereof, said pin being inserted in an elongated hole provided in said link, said link member being moved as said disk is rotated.

10. A photosensitive-material conveying apparatus according to claim 1, wherein said pushing-out member has a pushing-out plate, an arm member connected to said pushing-out plate, a pushing-out-member driving member, and a cam member connected to said pushing-out-member driving member and having an outer periphery abutting against said arm member, said arm member being adapted to move said pushing-out plate as said cam member rotates.

11. A photosensitive-material conveying apparatus according to claim 10, wherein said arm member is rotatably supported at a longitudinally intermediate portion thereof, has at one end thereof a bearing, and abuts against the outer periphery of said cam member via said bearing, another end of said arm member being connected to said pushing-out plate.

12. A photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, said photosensitive-material conveying apparatus being adapted to stack the cut photosensitive material in a predetermined unit, said photosensitive-material conveying apparatus comprising:

an endlessly conveying section disposed above said main body and on a photosensitive-material discharging side of said cutter section, an upper portion of said endlessly conveying section being disposed in a vicinity of said discharging section, a lower portion of said endlessly conveying section being disposed at a position remote from said discharging section, such that a conveying direction is inclined with respect to a vertical direction;

a placing member disposed below said discharging section so as to place thereon the cut photosensitive material discharged from said discharging section;

a photosensitive-material receiving member provided in said endlessly conveying section to place thereon the cut photosensitive material discharged from said discharging section; and a driving member capable of moving said photosensitive-material receiving member until a discharging section-side end of said photosensitive-material receiving member is located on an upstream side, as viewed in a direction of flow of the photosensitive material being discharged, of a vertical line passing through a discharging end of said discharging section when said photosensitive-material receiving member is located in a vicinity of said discharging section.

13. A photosensitive-material conveying apparatus according to claim 12, wherein said photosensitive-material receiving member has an abutting portion which moves as said abutting portion abuts against said driving member.

14. A photosensitive-material conveying apparatus according to claim 13, wherein said driving member has a moving block for abutting against said abutting portion and a moving-block driving source for moving said moving block, and moves said photosensitive-material receiving member as said moving-block driving source is actuated when said abutting portion abuts against said moving block.

15. A photosensitive-material conveying apparatus according to claim 14, wherein said driving member has a feed screw which is threadedly engaged in an internal thread provided in said moving block and moves said moving block by receiving a rotating force from said moving-block driving source.

16. A photosensitive-material conveying apparatus for conveying a photosensitive material, said photosensitive-material conveying apparatus comprising:

an endlessly conveying section;

a stacking member provided in said endlessly conveying section to stack the photosensitive material thereon;

a guide member provided along a conveying passage of said endlessly conveying section; and an inclination preventing member provided in said stacking member to maintain said stacking member in a predetermined orientation as said inclination preventing member is guided by said guide member.

17. A photosensitive-material conveying apparatus according to claim 16, wherein said inclination preventing member is a roller which rotates by coming into contact with said guide member.

18. A photosensitive-material conveying apparatus according to claim 16, wherein said guide member is a guide rail provided along the conveying passage in which the photosensitive material is stacked on said stacking member.

19. A photosensitive-material conveying apparatus which is provided on a printer processor including a main body for effecting printing, development, and dry processing, a cutter section disposed on the main body for cutting a photosensitive material subjected to dry processing into predetermined lengths, and a discharging section disposed in a vicinity of an upper portion of the cutter section for discharging the cut photosensitive material laterally of the cutter section, said photosensitive-material conveying apparatus being disposed on a photosensitive-material discharging side of said discharging section, said photosensitive-material conveying apparatus comprising:

a placing member disposed below said discharging section to place thereon the photosensitive material discharged from said discharging section;

a conveying member having a photosensitive-material receiving member which is disposed laterally of said placing member to place the photosensitive material thereon, said conveying member being adapted to convey the photosensitive material from a lateral direction of said placing member to a predetermined position;

a pushing-out member for pushing out the photosensitive material onto said photosensitive-material receiving member located laterally of said placing member as said pushing-out member abuts against a discharging section-side end of the photosensitive material placed on said placing member; and a stopper disposed on a side of said photosensitive-material receiving member which is away from a side thereof where said placing member is disposed, said stopper being adapted to hold an end of the photosensitive material so that the photosensitive material placed on said photosensitive-material receiving member is not offset toward a side of a predetermined position which is away from a discharge section side thereof.

20. A photosensitive-material conveying apparatus according to claim 19, wherein said stopper retreats when said pushing-out member pushes out the photosensitive material.

* * * * *